US008077123B2

(12) United States Patent
Naugler, Jr.

(10) Patent No.: US 8,077,123 B2
(45) Date of Patent: Dec. 13, 2011

(54) EMISSION CONTROL IN AGED ACTIVE MATRIX OLED DISPLAY USING VOLTAGE RATIO OR CURRENT RATIO WITH TEMPERATURE COMPENSATION

(75) Inventor: Walter Edward Naugler, Jr., Katy, TX (US)

(73) Assignee: Leadis Technology, Inc., Sunnyvale, CA (US)

( * ) Notice: Subject to any disclaimer, the term of this patent is extended or adjusted under 35 U.S.C. 154(b) by 939 days.

(21) Appl. No.: 12/050,700

(22) Filed: Mar. 18, 2008

(65) Prior Publication Data

US 2008/0231558 A1 Sep. 25, 2008

Related U.S. Application Data

(60) Provisional application No. 60/919,229, filed on Mar. 20, 2007, provisional application No. 60/919,227, filed on Mar. 20, 2007.

(51) Int. Cl.
*G09G 3/30* (2006.01)

(52) U.S. Cl. ..... 345/76; 345/82; 315/169.3

(58) Field of Classification Search ..... 345/76–83; 315/169.3

See application file for complete search history.

(56) References Cited

U.S. PATENT DOCUMENTS

| | | | | |
|---|---|---|---|---|
| 6,414,661 | B1 | 7/2002 | Shen et al. | |
| 6,456,016 | B1 | 9/2002 | Sundahl et al. | |
| 6,501,230 | B1 * | 12/2002 | Feldman | 315/169.3 |
| 6,504,565 | B1 | 1/2003 | Narita et al. | |
| 6,710,548 | B2 | 3/2004 | Kimura | |
| 6,995,519 | B2 | 2/2006 | Arnold et al. | |
| 7,167,169 | B2 | 1/2007 | Libsch | |
| 2002/0167474 | A1 | 11/2002 | Everitt | |
| 2003/0071821 | A1 | 4/2003 | Sundahl et al. | |
| 2003/0122813 | A1 | 7/2003 | Ishizuki et al. | |
| 2004/0070558 | A1 * | 4/2004 | Cok et al. | 345/76 |
| 2004/0135749 | A1 * | 7/2004 | Kondakov et al. | 345/82 |
| 2004/0150594 | A1 | 8/2004 | Koyama et al. | |
| 2004/0212573 | A1 | 10/2004 | Sundahl et al. | |
| 2005/0030267 | A1 * | 2/2005 | Tanghe et al. | 345/82 |
| 2005/0110420 | A1 * | 5/2005 | Arnold et al. | 315/169.3 |
| 2006/0214888 | A1 * | 9/2006 | Schneider et al. | 345/76 |
| 2006/0227084 | A1 | 10/2006 | Cok | |

FOREIGN PATENT DOCUMENTS

JP 2002-278514 A 9/2002

OTHER PUBLICATIONS

PCT International Search Report and Written Opinion, PCT/US08/57532, Aug. 8, 2008, 10 pages.
PCT International Search Report and Written Opinion, PCT/US08/57534, Aug. 7, 2008, 9 pages.

* cited by examiner

*Primary Examiner* — Lun-Yi Lao
*Assistant Examiner* — Sosina Abebe
(74) *Attorney, Agent, or Firm* — Fenwick & West LLP

(57) ABSTRACT

Compensation needed to be made for reduced light efficiency in aged sub-pixels of an active matrix organic light-emitting diode (OLED) display are determined using a current ratio or a voltage ratio pertaining to an aged sub-pixel relative to un-aged, reference sub-pixels. When the current through the sub-pixels or the voltage across the sub-pixels are measured to determine the age of the sub-pixels, correction is made to the measured current or voltage to account for variations in the ambient temperature in which the OLED display is placed.

18 Claims, 13 Drawing Sheets

| Table of Tap voltages and resistors | | | | | |
|---|---|---|---|---|---|
| | Volts | Resistor Group | Ohm | A | Resistor Range |
| Vtap0 | 1.541 | Group 0 | 0 | 1.526E-11 | |
| Vtap1 | 2.854 | Group 1 | 7843 | 1.662E-08 | R30 to R0 |
| Vtap2 | 4.166 | Group 2 | 7843 | 6.447E-08 | R63 to R31 |
| Vtap3 | 5.479 | Group 3 | 7843 | 1.436E-07 | R95 to R64 |
| Vtap4 | 6.791 | Group 4 | 7843 | 2.539E-07 | R127 to R96 |
| Vtap5 | 8.104 | Group 5 | 7843 | 3.955E-07 | R159 to R128 |
| Vtap6 | 9.416 | Group 6 | 7843 | 5.684E-07 | R191 to R160 |
| Vtap7 | 10.729 | Group 7 | 7843 | 2.384E-07 | R223 to R192 |
| V gamma | 12.000 | Group 8 | 7843 | 1.00E-06 | R254 to R224 |

600

| | | | |
|---|---|---|---|
| 3250 Hours 626 | 3500 Hours 628 | 3750 Hours 630 | 4000 Hours 632 |
| 2250 Hours 618 | 2500 Hours 620 | 2750 Hours 622 | 3000 Hours 624 |
| 1250 Hours 610 | 1500 Hours 612 | 1750 Hours 614 | 2000 Hours 616 |
| 250 Hours 602 | 500 Hours 604 | 750 Hours 606 | 1000 Hours 608 |
| Reference Pixels (Not Aged) 632 | | | |

FIG. 6

EMISSION CONTROL IN AGED ACTIVE MATRIX OLED DISPLAY USING VOLTAGE RATIO OR CURRENT RATIO WITH TEMPERATURE COMPENSATION

CROSS-REFERENCE TO RELATED APPLICATION

This application claims priority under 35 U.S.C. §119(e) from (i) U.S. Provisional Patent Application No. 60/919,229 entitled "Temperature and Ambient Light Compensation for Active Matrix Emissive Displays Using Current Ratios to Control Pixel Emission Levels," filed on Mar. 20, 2007 and (ii) U.S. Provisional Patent Application No. 60/919,227 entitled "Temperature and Ambient Light Compensation for Active Matrix Emissive Displays Using Voltage Ratios to Control Pixel Emission Levels," filed on Mar. 20, 2007, both of which are incorporated by reference herein in their entirety.

BACKGROUND OF THE INVENTION

1. Field of the Invention

The present invention relates to modifying the current fed to an aging OLED sub-pixel in order to maintain constant light emission at a desired gray level.

2. Description of the Related Arts

An OLED display is generally comprised of an array of organic light emitting diodes (OLEDs) that have carbon-based films disposed between two charged electrodes. Generally one electrode is comprised of a transparent conductor, for example, indium tin oxide (ITO). Generally, the organic material films are comprised of a hole-injection layer, a hole-transport layer, an emissive layer and an electron-transport layer. When voltage is applied to the OLED, the injected positive and negative charges recombine in the emissive layer and transduce electrical energy to light energy. Unlike liquid crystal displays (LCDS) that require backlighting, OLED displays are self-emissive devices—they emit light rather than modulate transmitted or reflected light.

An OLED display typically includes a plurality of OLEDs arranged in a matrix form including a plurality of rows and a plurality of columns, with the intersection of each row and each column forming a pixel of the OLED display. An OLED display is generally activated by way of a current driving method that relies on either a passive-matrix (PM) scheme or an active-matrix (AM) scheme.

In a passive matrix OLED display, a matrix of electrically-conducting rows and columns forms a two-dimensional array of picture elements called pixels. Sandwiched between the orthogonal column and row lines are thin films of organic material of the OLEDs that are activated to emit light when current is applied to the designated row and column lines. The brightness of each pixel is proportional to the amount of current applied to the OLED of the pixel. While PMOLEDs are fairly simple structures to design and fabricate, they demand relatively expensive, current-sourced drive electronics to operate effectively and are limited as to the number of lines because only one line can be on at a time and therefore the PMOLED must have instantaneous brightness equal to the desired average brightness times the number of lines. Thus, PMOLED displays are typically limited to under 100 lines. In addition, their power consumption is significantly higher than that required by an active-matrix OLED. PMOLED displays are most practical in alpha-numeric displays rather than higher resolution graphic displays.

An active-matrix OLED (AMOLED) display is comprised of OLED pixels that have been deposited or integrated onto a thin film transistor (TFT) array to form a matrix of pixels that emit light upon electrical activation. In contrast to a PMOLED display, where electricity is distributed row by row, the active-matrix TFT backplane acts as an array of switches coupled with sample and hold circuitry that control and hold the amount of current flowing through each individual OLED pixel during the total frame time. The active matrix TFT array continuously controls the current that flows to the OLEDs in the each of pixels, signaling to each OLED how brightly to illuminate.

FIG. 1 illustrates a conventional active matrix OLED display. While the example of FIG. 1 is illustrated as an OLED display, other emissive-type displays would have structures similar to that illustrated in FIG. 1. Referring to FIG. 1, the OLED display panel includes a plurality of rows Row 1, Row 2, . . . , Row Y and a plurality of columns Col. 1, Col. 2, . . . , Col. X arranged in a matrix. The intersection of each row and each column forms a pixel of the OLED display. The OLED display also includes a Gamma network 104, row drivers 116-1, 116-2, . . . , 116-*y*, column drivers 114-1, 114-2, . . . , 114-*x*, and a timing controller 112.

For a color OLED display, each pixel includes 3 sub-pixels that have similar structure but emit different colors (R, G, B). For simplicity of illustration, FIG. 1 illustrates only one sub-pixel (denoted as dashed line boxes in FIG. 1, such as box 120) corresponding to one of the R, G, B colors per pixel at the intersection of each row and each column. However, in real OLED display panels, each pixel includes three identical ones of the sub-pixel structure 120 as illustrated in FIG. 1. As shown in FIG. 1, the active drive circuitry of each sub-pixel 120 includes TFTs T1 and T2 and a storage capacitor Cs for driving the OLED D1 of the sub-pixel 120. In the following explanation of FIG. 1, the type of the TFTs T1 and T2 is a p-channel TFT. However, note that n-channel TFTs may also be utilized in the active matrix.

Image data 110 includes data indicating which sub-pixel 120 of the OLED display should be turned on and the brightness of each sub-pixel. Image data 110 is sent by an image rendering device (e.g., graphics controller (not shown herein)) to the timing controller 112, which coordinates column and row timing. The timing controller 112 sends digital numbers (DN) 101 indicating pixel brightness to the gamma network 104. Row timing data 105 included in image data 110 is coupled to the gate lines 150 of each row through its corresponding row driver 116-1, 116-2, . . . , 116-*y*. Row drivers 116-1, 116-2, . . . , 116-*y* drive the gate line 150 so that the gate lines 150 carry a voltage of 25 to 30 volts when active. The gates of TFTs T2 of each sub-pixel in a row are connected to gate line 150 of each row to enable TFTs T2 to operate as switches. The data lines 160 are connected to the sources of TFTs T2 in each column. When the gate line 150 becomes active for a row based on the row timing data 105, all the TFTs T2 in the row are turned on. Timing controller 112 sends column timing data 106 to the column drivers 114-1, 114-2, . . . , 114-*x*. The Gamma network 104 generates the T1 gate voltages 102 (brightness) to be applied to each TFT T1 in the row when the sub-pixel 120 is turned on, based on digital numbers (DNs) 101 corresponding to each gate voltage 102. Column drivers 114-1, 114-2, . . . , 114-*x* provides analog voltages 160 to be applied to the gates of TFTs T1, corresponding to the T1 gate voltages 102. The voltages 102 representing pixel brightness values are distributed from the Gamma network 104 to all the column drivers 114-1, 114-2, . . . , 114-*x* in parallel after the appropriate T1 gate voltages 102 have been sent from gamma network 104 to each column driver 114-1, 114-2, . . . , 114-*x* under control of the column timing data 106 from timing controller 112. Under control of the timing controller 112, for example, row driver 1 (116-1) is activated and all the voltages 102 placed on the column drivers 114-1, 114-2, . . . , **114-*x* are downloaded to the TFT T1s in row 1. Timing controller 112 then proceeds to send brightness data for the next row (e.g., row 2) using the row driver 2 (116-2) to column drivers 114-1 through 114-*x* and activating row 2 and so forth, until all rows have been activated and brightness data for the total frame has been downloaded and all the sub-pixels are turned on to the brightness indicated by the image data 110**.

The drain of TFT T2 is connected to the gate of TFT T1 and to one side of storage capacitor Cs. The source of TFT T1 is connected to positive supply voltage VDD. The other side of storage capacitor Cs is also connected, for example, to the positive supply voltage VDD and to the source of TFT T1. Note that the storage capacitor Cs may be tied to any reference electrode in the pixel. The drain of TFT T1 is connected to the anode of OLED D1. The cathode of OLED D1 is connected to negative supply voltage Vss or common Ground. The analog voltages 160 are downloaded to the OLED display a row at a time.

When TFT T2 is turned on, the analog T1 gate voltage 160 is applied to the gate of each TFT T1 of each sub-pixel 120, which is locked by storage capacitor Cs. When the row scan moves to the next row, the gate voltage of TFT T1 is locked for the frame time until the next gate voltage for that sub-pixel is sent by the column drivers 114-1, 114-2, . . . , **114-*n*. In other words, the continuous current flow to the OLEDs is controlled by the two TFTs T1, T2 of each sub-pixel. TFT T2 is used to start and stop the charging of storage capacitor Cs, which provides a voltage source to the gate of TFT T1 at the level needed to create a constant current to the OLED D1. As a result, the AMOLED display operates at all times (i.e., for the entire frame scan), avoiding the need for the very high instantaneous currents required for passive matrix operation. The TFT T2 samples the data on the data line 160, which is held as charge stored in the storage capacitor Cs. The voltage held on the storage capacitor Cs is applied to the gate of the second TFT T1. In response, TFT T1 drives current through the OLED D1** to a specific brightness depending on the value of the sampled and held data signal as stored in the storage capacitor Cs.

FIG. 2 illustrates a conventional gamma network used with an active matrix OLED display. The gamma network 104 is a circuit that converts the brightness data for a sub-pixel from a digital number (DN) representing the desired gray level (brightness) to an analog voltage, which will produce the right amount of current to drive OLED D1 to emit the desired brightness when the analog voltage 160 is applied to the gate of TFT T1 in the sub-pixel 120 (See FIG. 1). For example, the gamma network 104 in FIG. 2 is a conventional 8 bit gamma network used with DN (8 bits) ranging from 0 to 255. Gamma network 104 includes a counter 202, a decoder 204, a series of resistors (R0, . . . , R30, . . . R191, . . . , R223, . . . , R253, R254) (255 resistors for an 8 bit system) and 256 switches GT0, GT1, . . . , GT255. The gate of each switch GT0, GT1, . . . , GT255 is coupled to the corresponding one of the bits of decoder 204. When the corresponding binary bit at the decoder 204 is "1" the corresponding switch (GT0, GT1, . . . , GT255) is turned on, and when the binary bit at the decoder 204 is "0" the corresponding switch (GT0, GT1, GT255) is turned off. DN 101 can be any value between 0 and 255 for an eight bit system. Counter 202 counts up to the value of DN 101 sent to the Gamma network 104, causing decoder 204 to move its output to the gate of the gamma table switches GT(DN). For example, if a DN of 185 indicating brightness level 185 was sent to counter 202, decoder 204 would move its output to GT185, thereby switching switch GT185 on. Gamma network 104 is essentially a voltage divider with 256 taps corresponding to 256 gray levels (brightnesses). The voltage at tap 185 is controlled by switch GT185, which when turned on delivers to the gate of the TFT T1 in the specified sup-pixel the voltage calculated to produce a gray level brightness corresponding to DN 185.

The voltage 102 output from the gamma network 104 is designed to produce a series of currents from TFT T1 that will produce 256 levels (in an 8 bit display system) of light emission from OLED D1 conforming to the brightness response of the human eye. The human eye is logarithmically sensitive to brightness and thus approximately has a linear response approximate to the square of brightness. That is, for the human eye to experience a doubling of brightness, the light flux has to be increased approximately 4 times. This relationship of eye response to light flux (brightness) is known as the gamma function (γ), which is not exactly 2 but closer to 2.2. In general, gamma gives contrast to the image. If, for example, gamma is reduced to 1 (a linear relationship between eye response and light), the images produced would have very low contrast, and be flat and very uninteresting. If gamma is increased, contrast of the image increases. Note that gamma refers to the relationship between the eye and light—not current or voltages. OLED emission is produced by current flowing through OLED D1 as controlled by TFT T1. Thus, it is the function of the gamma network 104 to produce an appropriate voltage, which will produce appropriate current through OLED D1, which will produce light with the correct (or desired) gamma function. The emission of light from OLED material is linear to the current. That is, in order to double the luminance (expressed as $cd/m^2$—candelas per meter squared), current is doubled.

The brightness values in an image are represented as digital numbers (DNs). For an 8-bit display system, DNs range from 0 to 255. The light values are called gray scale levels and are linear to the human eye. Thus, a doubling of DNs is perceived by the human eye as a doubling of brightness. The gamma relation between DNs and the current of TFT T1 can be determined as follows. FIG. 3A illustrates the gamma curve showing the relationship between the digital number (DN) and the OLED current. Note that gamma curve 300 is not linear but has a curve with a changing slope. The exact shape of the gamma curve 300 is determined by the desired gamma. The gamma curve 300 shown in FIG. 3A is for a gamma of 2.

FIG. 3B is a table showing example resistors, voltages and currents for the gamma network in FIG. 2. Referring to FIGS. 2 and 3B, note that the resistors (R0 through R254) are grouped with roughly 32 resistors per group, except Group 0 that includes no resistor, although all the resistors are not shown in FIG. 2 for simplicity of illustration. Each resistor group (Group 0 through Group 8) is associated with a tap voltage Vtap0 through Vtap7 and Vgamma. The tap voltages, for example, are bounded by a minimum voltage (1.541 volts) and a maximum voltage (Vgamma, 12.000 volts). The tap voltages coupled with the minimum and maximum voltages establish the gamma current curve 300 with the aid of resistors R0 through R254. The tap voltages are voltage sources, and thus the voltage established between each resistor is determined by the current drawn between the tap voltages. The greater the number of tap voltages, the better current conformation is to the gamma curve. In the example of FIG. 3B, nine voltage sources produce the voltages at each resistor (R0 through R254), which in turn use TFT T1 to produce the current that conforms to the gamma curve 300. By adjusting the tap voltages, the gamma current curve 300 will change.

The gate voltage 102 to the TFT T1 is determined by the tap voltages, resistors, and which of the switches GT0, . . . , GT255 is turned on. For example, when DN is 255, counter 202 moves the output of decoder 204 to the gate line for GT255; thereby connecting Vgamma voltage to line 102 which connects to the column driver of the selected sub-pixel. Since the Vgamma voltage is the maximum voltage put out by the Gamma Network 104, the maximum voltage is placed on the gate of T1 in the selected sub-pixel. This maximum voltage causes TFT T1 in the selected sub-pixel to supply the current to OLED D1 for the brightest gray level for the sub-pixel. The voltage value of Vgamma is determined by the design of T1 and the designed top brightness of the sub-pixel. The methods of doing such design work are well known in the display industry. The table in FIG. 3B is an example of design voltages for Vgamma and the taps on the voltage divider. For example, the design voltage for Vgamma from FIG. 3B is 12 V. As a further example, if the sub-pixel is scheduled by the image data to be black (off) then DN 0 is sent to the gamma network 104 causing counter 202 to move the output of decoder 204 to switch GT0 connecting Vtap0 to the output line 102. The voltage value of Vtap0 from the table in FIG. 3B is 1.541 Volts, which when supplied to the gate of T1 through the column driver for the selected sub-pixel causes the current supplied to OLED D1 to be less than the threshold current for OLED D1 and therefore, no light will be emitted from the sub-pixel for the frame. The taps on the gamma network voltage divider 104 will be between Vgamma and Vtap0 (12 Volts and 1.541 Volts, respectively, in the example). As a further example, if DN 227 is sent to gamma network 104, counter 202 will move the output of decoder 204 to the gate line for switch GT227 connecting to the aforesaid voltage divider 104 at a point between Vgamma and Vtap7. The exact voltage connected through switch GT227 to output line 102, and thus, to the gate of TFT T1 in the selected sub-pixel will be determined by the voltage drop from Vgamma to Vtap7, which from the table in FIG. 3B is determined to be 12 Volts−10.729 Volts=1.271 Volts. There are 31 resistors (255−224=31) between Vgamma and Vtap7; therefore, the voltage is dropped in 31 equal decrements from Vgamma to Vtap, because all 31 resistors are of the same value, which from the FIG. 3B is 7843 Ohms each. Each voltage drop, therefore, is 1.271/31=0.041 volts. There are 28 resistors (255−227) between the GT227 tap and the GT255 tap; therefore, the voltage drop is 28×0.041=1.148 Volts. The exact voltage sent to the selected sub-pixel through output line 102 and the column driver to the gate of TFT T1 is 12 volts−1.148 Volts=10.852 Volts, which is the T1 gate voltage designed to supply the required current to OLED D1 to emit brightness corresponding to gray level 227. The other voltages at the various gray levels are calculated in the same manner.

Referring back to FIG. 1, the OLED display 100 requires regulated current in each sub-pixel to produce a desired brightness from the pixel. Ideally, the TFTs T1 in each sub-pixel 120 should be good current sources that deliver the same current for the same gate voltage over the lifetime of the OLED display. Also each current source TFT T1 in the active TFT matrix must deliver the same current for the same data voltage stored in the storage capacitor Cs in order that the display is uniform.

Note that there are two types of thin film semiconductors in popular use in the active matrix display industry: amorphous silicon (a-Si) and poly-silicon (p-Si). Emissive displays, such as the active matrix OLED (AMOLED) displays, require high current and stability not available in the a-Si TFTs and therefore typically use p-Si for the TFTs T1, T2. a-Si is converted to p-Si by laser annealing the a-Si to increase the crystal grain size and thus convert a-Si to p-Si. The larger the crystal grain size, the faster and more stable is the resulting semiconductor material. Unfortunately the grain size produced in the laser anneal step is not uniform due to a temperature spread in the laser beam. Thus, uniform TFTs T1, T2 are very difficult to produce and thus the current supplied by TFTs T1 in conventional OLED displays is often non-uniform, resulting in non-uniform display brightness. Non-uniform TFTs T1 throughout the OLED display causes "Mura" or streaking in the OLED displays made with p-Si TFTs. In other words, TFTs T1 may produce different OLED current due to its non-uniformities from sub-pixel to sub-pixel, even if the same gate voltage is applied to the TFTs T1. Therefore, it is necessary to compensate for non-uniformities in the TFTs T1 by applying corrected (compensated) T1 gate voltages that are different from the intended gate voltage from the graphics board (not shown) to the TFTs T1. This can be done by measuring the gray level (gate voltage) versus current characteristics of the TFTs T1 for each sub-pixel, and using such current measurement data to compensate for the non-uniformities in TFTs T1 when driving the TFTs T1 with the gate voltage 102 through the gamma network 104.

Another problem with AMOLED displays occurs due to aging of the material in the OLEDs. As the OLED sub-pixels age with use, OLEDs become less efficient in converting current to light, i.e., the efficiency of light emission of the OLEDs decreases. Thus, as OLED current to light efficiency of the OLED material decreases with use (age), light emitted from an OLED sub-pixel for a given DN number also decreases, because the gamma network 104 in conventional AMOLED does not compensate for the decreased efficiency of light emission in the aged OLED sub-pixels. As a result, the OLED display emits less light for display than desired in response to a given DN. In addition, since the OLED sub-pixels on various parts of the AMOLED display do not age (are not used) equally in a uniform manner, OLED aging also causes non-uniformity in the OLED display.

Thus, there is a need to solve problems associated with aging of the OLED sub-pixels.

SUMMARY OF THE INVENTION

Embodiments of the present invention include methods of determining the amount of compensation needed for reduced light efficiency in aged sub-pixels of an active matrix organic light-emitting diode (OLED) display, using a current ratio or a voltage ratio pertaining to an aged sub-pixel relative to un-aged, reference sub-pixels. When the current through the sub-pixels or the voltage across the sub-pixels are measured to determine the age of the sub-pixels, correction is made to the measured current or voltage to account for variations in the ambient temperature in which the OLED display is placed.

According to the present invention, it is possible to conveniently determine the age of an aged sub-pixel relative to an un-aged reference sub-pixel using voltage ratios or current ratios, and correlate such age measurement with the correction that needs to be made to the DNs in order to compensate for reduced light efficiency of the aged sub-pixels of the OLED display. When determining the age of the sub-pixels, deviations that may be caused by variations in the ambient temperature from the temperature in controlled environments are also compensated for according to the various embodiments of the present invention.

The features and advantages described in the specification are not all inclusive and, in particular, many additional features and advantages will be apparent to one of ordinary skill in the art in view of the drawings, specification, and claims. Moreover, it should be noted that the language used in the specification has been principally selected for readability and instructional purposes, and may not have been selected to delineate or circumscribe the inventive subject matter.

BRIEF DESCRIPTION OF THE DRAWINGS

The teachings of the embodiments of the present invention can be readily understood by considering the following detailed description in conjunction with the accompanying drawings.

FIG. 6 illustrates how an AMOLED display is aged, according to one embodiment of the present invention.

DETAILED DESCRIPTION OF EMBODIMENTS

The Figures (FIG.) and the following description relate to preferred embodiments of the present invention by way of illustration only. It should be noted that from the following discussion, alternative embodiments of the structures and methods disclosed herein will be readily recognized as viable alternatives that may be employed without departing from the principles of the claimed invention.

Reference will now be made in detail to several embodiments of the present invention(s), examples of which are illustrated in the accompanying figures. It is noted that wherever practicable similar or like reference numbers may be used in the figures and may indicate similar or like functionality. The figures depict embodiments of the present invention for purposes of illustration only. One skilled in the art will readily recognize from the following description that alternative embodiments of the structures and methods illustrated herein may be employed without departing from the principles of the invention described herein.

Figure 1:
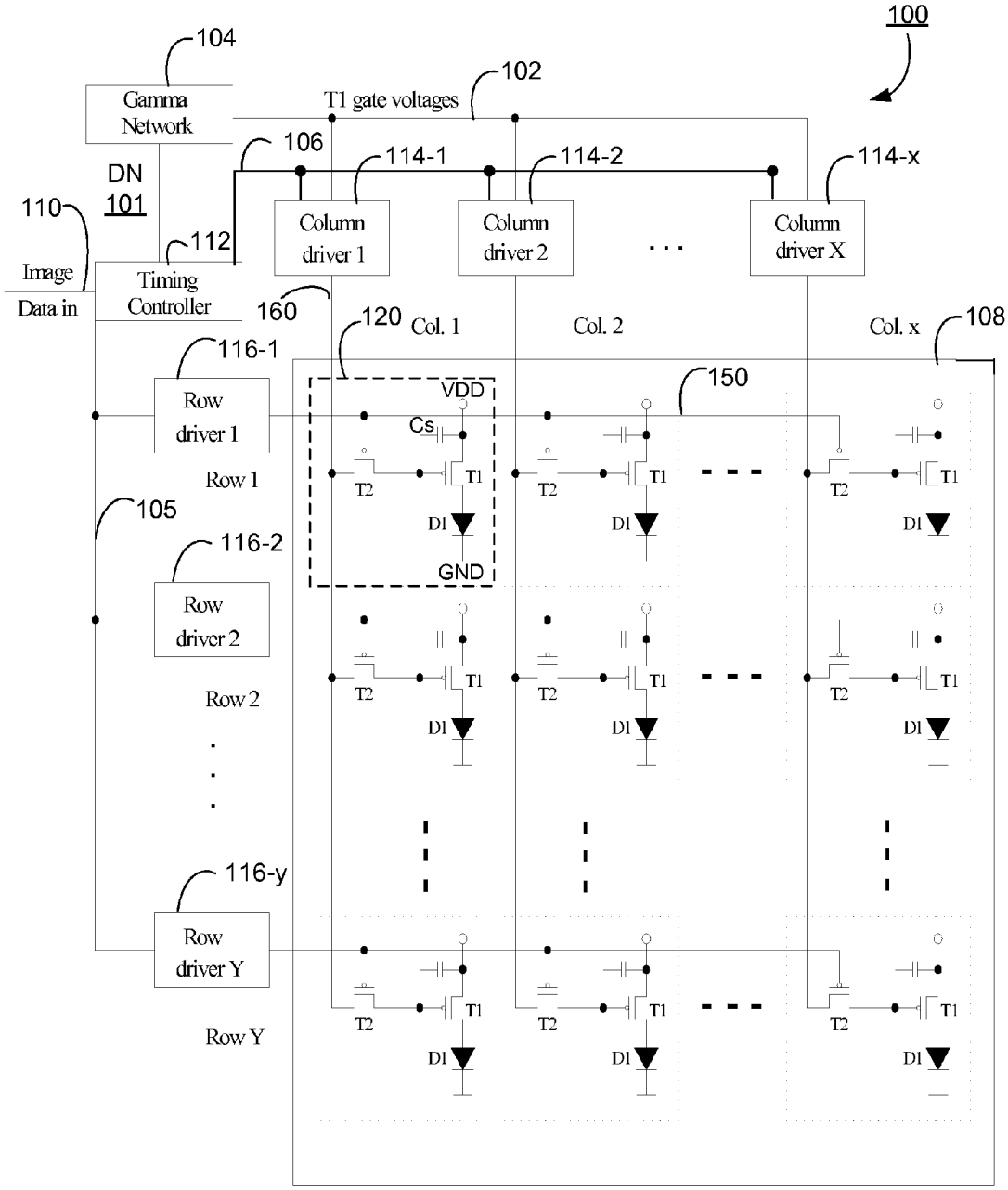
FIG. 1 (PRIOR ART)
FIG. 1 illustrates a conventional active matrix OLED display.
Figure 2:
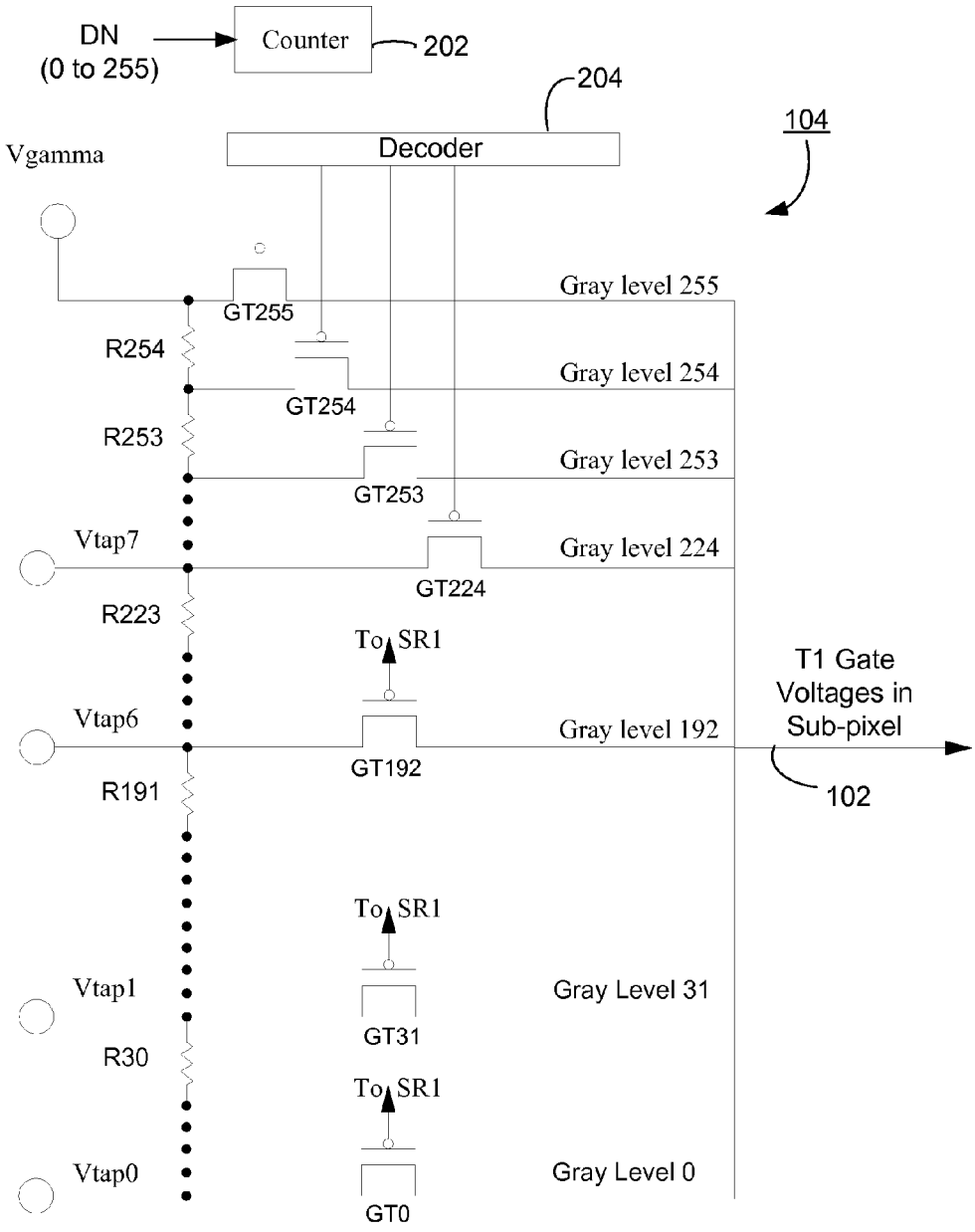
FIG. 2 (PRIOR ART)
FIG. 2 illustrates a conventional gamma network used with an active matrix OLED display.
Figures 3A, 3B:
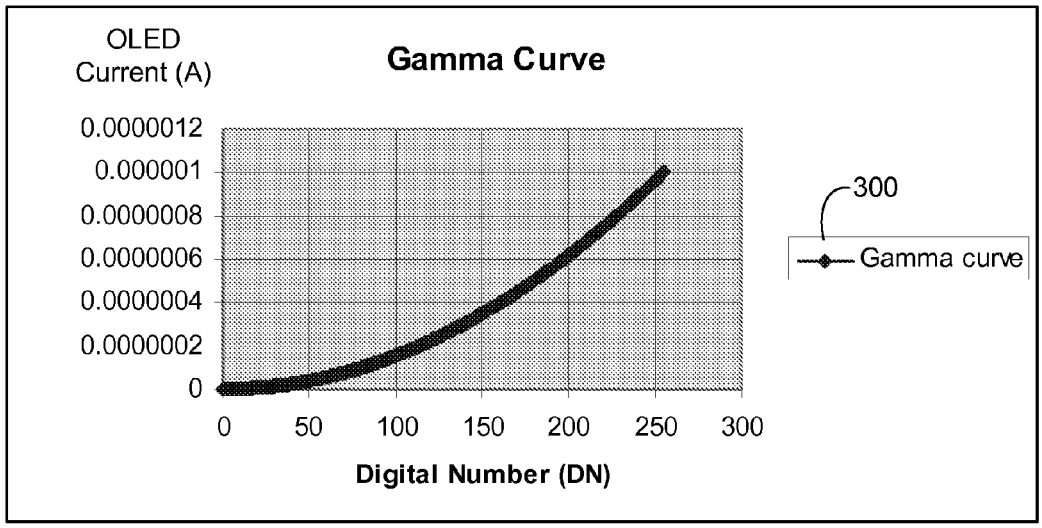
FIG. 3A (PRIOR ART)
FIG. 3B (PRIOR ART)
FIG. 3A illustrates a gamma curve showing the relationship between the digital number (DN) and the OLED current.
FIG. 3B is a table showing example resistors, voltages and currents for the gamma network in FIG. 2.
Figure 4A:
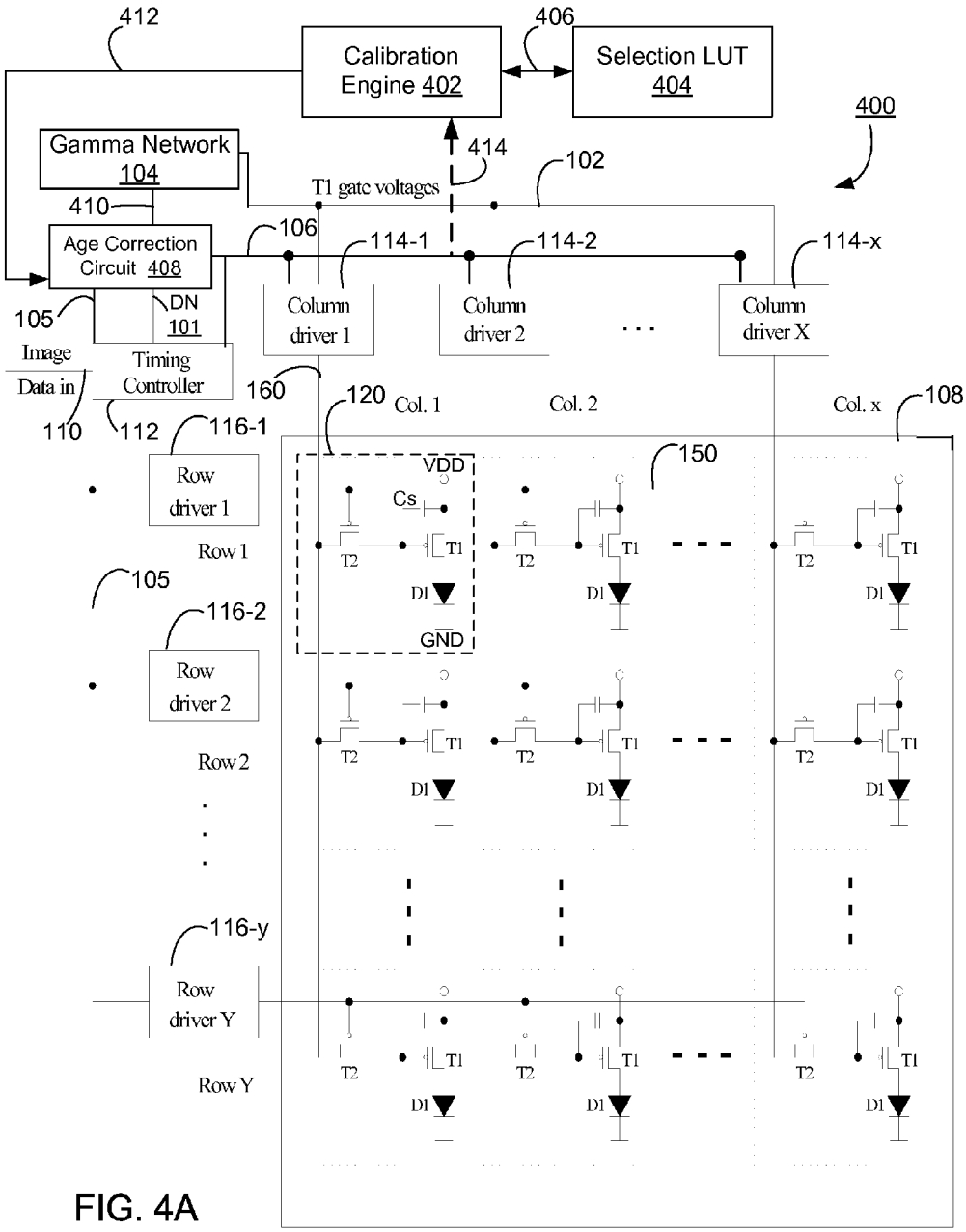
FIG. 4A illustrates an active matrix OLED display, according to one embodiment of the present invention.
Figure 4B:
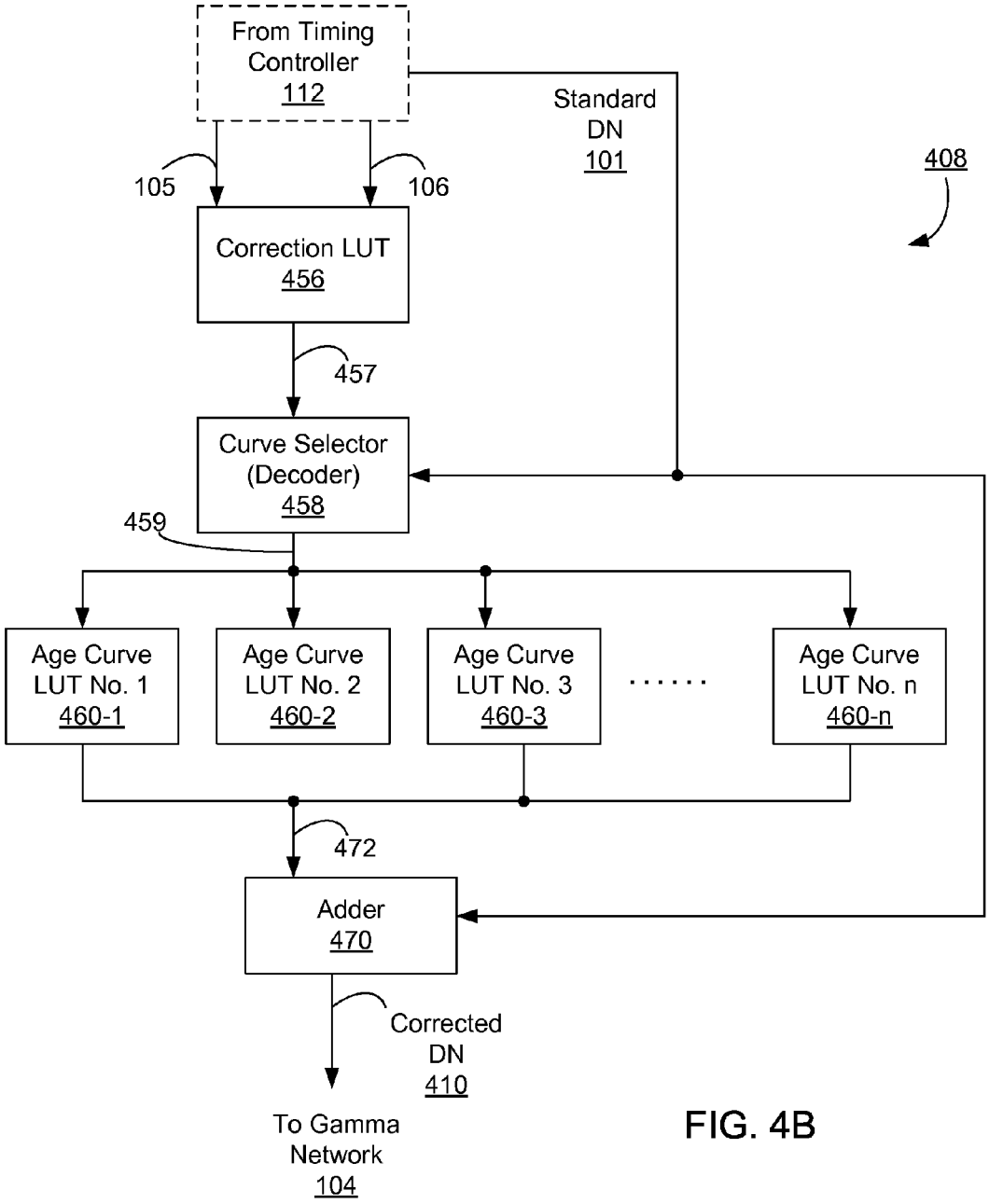
FIG. 4B illustrates the age correction circuit shown in FIG. 4A in more detail, according to one embodiment of the present invention.

FIG. 4A illustrates an active matrix OLED display according to one embodiment of the present invention, and FIG. 4B illustrates the age correction circuit shown in FIG. 4A in more detail according to one embodiment of the present invention. FIGS. 4A and 4B will be explained together. Referring to FIG. 4A, the AMOLED display 400 of FIG. 4A is substantially the same as the AMOLED display 100 of FIG. 1, except that a calibration engine 402, a selection look-up table (LUT) 404, and an age correction circuit 408 are added. The age correction circuit 408 receives the standard DN 101, row timing data 110, and column timing data 106, and generates a corrected DN 410 compensating for error introduced by aging of the OLED sub-pixels for output to gamma network 104.

Referring to FIG. 4B, age correction circuit 408 includes correction LUT 456, curve selector 458, age curve LUTs 460-1, 460-2, 460-3, . . . , **460-*n*, and adder (summing function) 470. Age curve LUTs 460 store the DN level increase (or decrease) ΔDN relative to the standard DN 101 that is needed to force the aged OLED sub-pixels to display the desired brightness as represented by the standard DN 101. In other words, age curve LUTs 460 store mappings from standard DN 101 to ΔDN 472. Methods of determining the age curve content to store in the age curve LUTs 460 are described below with reference to FIGS. 7A and 7B. Each sub-pixel 120 (or pixel) is assigned to one of the age curve LUTs 460 for age correction. Correction LUT 456 stores the mapping between the sub-pixel number and one of the age curve LUTs 460** to use for that sub-pixel number, during normal operation.

Referring to both FIGS. 4A and 4B, during manufacturing or testing of an AMOLED display, voltage ratios or current ratios from the OLED sub-pixels 120 may be measured 414, as explained in more detail below with reference to FIGS. 7A and 7B, to determine the age of the OLED of the sub-pixel and obtain light emission characteristics of aged sub-pixels for different ages of the sub-pixels. Such determined light emission characteristics of the aged sub-pixels for different ages may be stored in each of the age curve LUTs 460 for each age, as mappings between a standard DN 101 and a correction (ΔDN) 472 (increase or decrease) to the standard DN 101 that needs to be made for that age of the sub-pixel. Mappings between a particular age of an OLED sub-pixel and a particular age curve LUT 460 to use for that age are stored in selection LUT 404. The process of filling the content in the age curve LUTs 460 and selection LUT 404 may be completed during manufacturing or testing of the AMOLED display, before the AMOLED displays are put in actual use.

Referring to both FIGS. 4A and 4B, after the OLED display has been in actual use and during a calibration phase of the AMOLED display, calibration engine 402 determines the age of the aged sub-pixel 120 using voltage ratio or current ratio as explained in more detail with reference to FIGS. 9A and 9B, and then determines the age curve LUT 460 to use for that aged sub-pixel by looking up the selection LUT 404. Then, calibration engine 402 updates 412 correction LUT 456 based on the determined age of the aged sub-pixel, so that the particular aged sub-pixel being calibrated is assigned to the proper age curve LUT 460 for that determined age. Calibration phase can occur, for example, while the electronic device (e.g., mobile phone) in which the OLED display is used is not in normal operation (e.g., in charge mode of the mobile phone).

In normal operation, the standard DN 101 for a sub-pixel 120 is corrected by the age correction circuit 408 to a corrected DN value 410, which is input to the gamma network 104 to drive the T1 gate voltage 102. This is explained in more detail in FIG. 4B. Correction LUT 456 receives row timing data 105 and column timing data 106 that include the row and column numbers to be driven, respectively, from timing controller 112, and determines which pixel (sub-pixel) is to be driven by the graphics controller (not shown). As explained above, correction LUT 456 stores mappings between the sub-pixel numbers (identified by row number 105 and column number 106) and the number of the assigned age curve LUT 460 to use for that sub-pixel, as a result of calibration of the aged pixels by calibration engine 402 as explained above and below in more detail with reference to FIGS. 9A and 9B. Correction LUT 456 receives the row number 105 and the column number 106 of the sub-pixel of the OLED display that is currently being driven, and selects and outputs the age curve LUT number 457 to use for that sub-pixel. Curve selector 458 is essentially a decoder, and receives the selected curve number 457 and selects the corresponding one of the age curve LUTs 460-1, 460-2 . . . , **460-*n* to be used based on the selected curve number 457. For example, the selected age curve LUT number 457 may indicate that age curve LUT No. 3 460-3 should be used for the sub-pixel currently being driven, in which case curve selector 458 selects age curve LUT No. 3 (460-3**).

Meanwhile, the standard DN 101 output from timing controller 112 is input to curve selector 458 and adder 470. The selected age curve LUT no. 3 (460-3) selects the correction ΔDN (increase or decrease) needed to be made to the standard DN 101 to compensate for aging of the OLED material of the OLED sub-pixel, based on the received standard DN101. The correction ΔDN 472 is added to the standard DN101 by adder (summing function) 470 to generate the corrected DN 410. The corrected DN 410 is one that has been compensated for aging of the OLED sub-pixel, and is provided to gamma network 104 to drive the T1 gate voltage 102 of the aged OLED sub-pixel.

Note that in another embodiment, age curve LUTs 460 may store mappings between the standard DN 101 representing the desired pixel brightness and the actual corrected DN 410 that is required to force the aged OLED sub-pixels corresponding to that particular aged pixel to emit the desired brightness, rather than the correction ΔDN (increase or decrease) needed to be made to the DN 101. In such an embodiment, no adder is needed since the age curve LUTs 460 outputs the corrected DN 410 itself. However, in such embodiment more memory space would be needed to store the longer bits of the actual corrected DN 410.

The number of age curve LUTs needed for age compensation in the OLED display depends on the desired age resolution of the OLED display, i.e., the granularity of the age compensation desired. In one embodiment, when the OLED light emission efficiency has decreased to 50% of its un-aged efficiency, the OLED is deemed to have reached the end of its life. Assuming a 6-bit system is used to store the age curve LUT numbers, 50% divided by 64 ($=2^6$) results in 0.78% efficiency difference between adjacent age curves. For an OLED material that has a half-life of 20,000 hours, there would be an age curve spaced approximately every 312 hours (=20,000/64). Each of the 64 age curve LUTs would be associated with a particular age for which it contains DN correction data.

Figure 5A:
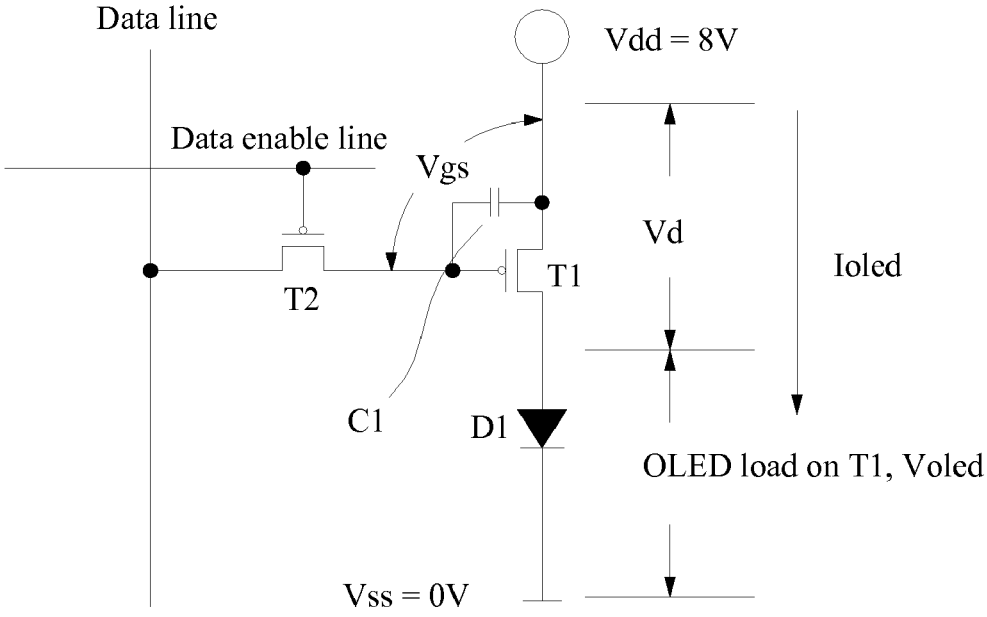
FIGS. 5A and 5B illustrate a sub-pixel of the AMOLED display in more detail.
Figure 5B:
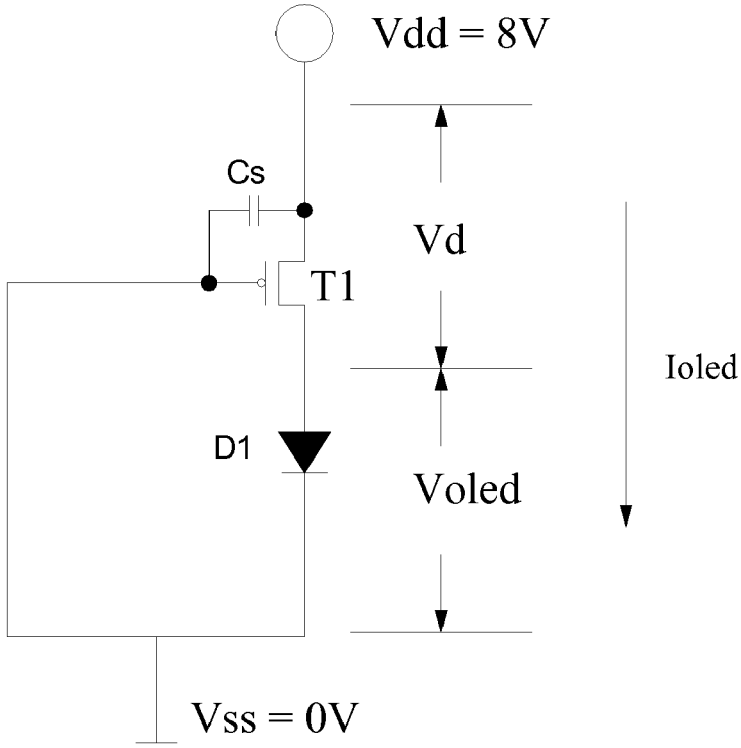

FIGS. 5A and 5B illustrate a sub-pixel of the AMOLED display in more detail. As shown in FIG. 5A, TFT T1 and OLED D1 are connected in series between supply voltages Vdd and Vss. The same current Ioled flows though both TFT T1 and OLED D1. When TFT T1 is biased in the saturation region, $Id=k\cdot(Vgs-Vt)^2$ (Equation 1) holds, where Vgs is the voltage between the gate and source of TFT T1, Vt is the threshold voltage of T1, Vds is the voltage from drain to source of TFT1, Id is the current through TFT T1, and k is a proportionality constant reflecting electron mobility of TFT T1. Thus, the magnitude of the current Ioled (current Id) when T1 is biased in the saturated region is controlled by the gate voltage on TFT T1. When TFT T1 is biased in the linear region, $Id=2k[(Vgs-Vt)\cdot Vds-Vds^2/2]$ (Equation 2) holds. If TFT T1 is biased in the linear region and its gate voltage is fixed, the current is controlled by its drain-source voltage Vd across T1. In addition, Vtotal=Vdd−Vss (Equation 3) and Vtotal=Vds+Voled (Equation 4), where Vtotal is the total voltage across TFT T1 and OLED D1, Vdd is the power supply voltage, Vd is the voltage across TFT T1, Voled is the voltage across OLED D1, and Vss is ground voltage (typically 0 volt).

If TFT T1 is placed in the linear mode by connecting the gate of TFT T1 to the cathode of OLED D1 as shown in FIG. 5B, the current Ioled is a function of the Voled and Vtotal. But since Voled is also a function of Ioled, Ioled cannot be found by just knowing Vtotal, which is the only voltage that can be directly measured. Knowing the threshold voltage Vt and k of TFT T1, current measurement of Ioled will allow the calculation of Vds from Equation 2, which can then be subtracted from Vtotal to obtain Voled. If a specific voltage Vtotal is applied to the sub-pixel 120, the sub-pixel circuit will settle to a current Ioled as a function of Vdd, Vss. Therefore, if two sub-pixels have the same Vdd and Vss and their gates are connected to the cathodes to put the OLEDs D1 in linear mode, then the current Ioled in the two sub-pixels should be identical, assuming that the TFTs T1 and OLED D1s in the two sub-pixels are identical. The TFT T1s in the two sub-pixels are assumed to be stable and both sub-pixels are assumed to be at the same temperature. If one sub-pixel is aged but another sub-pixel is not aged and identical Vdd and Vss are applied to both the aged sub-pixel and the un-aged sub-pixel (referred to herein as the "reference sub-pixel"), the current Ioled in the reference sub-pixel will be different from the current Ioled in the aged sub-pixel, i.e., the OLED current Ip in the aged sub-pixel will be less than the OLED current Ir in the reference sub-pixel. Stated in another way, larger Vtotal (Vdd−Vss) needs to be applied to the aged sub-pixel than to the reference sub-pixel to obtain the same current Ioled in the aged sub-pixel and the reference sub-pixel, due to the aged OLED D1 in the aged sub-pixel. These properties may be used to determine the age of a sub-pixel.

FIG. 6 illustrates how an AMOLED display is aged, according to one embodiment of the present invention. For example, aging of the AMOLED display is carried out as in FIG. 6 in the laboratory during characterization of the OLED production process, in order to determine the proper correction needed to be made to the DNs in the AMOLED displays put into actual use and aged. The active area 600 of the AMOLED test display is divided into a plurality of sections each of which is aged differently and at least one section with reference pixels that are not aged. For example, active area 600 includes 16 sections 602, 604, . . . , 630 and a reference pixel section 632. Each of the sixteen sections 602, 604, . . . , 632 contains thousands of pixels, and is aged by having current flow through its sub-pixels for a predetermined period of time, but with each section having different amounts of current flowing through its sub-pixels in order to produce sixteen different rates of aging. For example, section 602 is aged for 250 hours at a predetermined current level, say IA.

Section 604 is aged for 250 hours but at twice the predetermined current level (2·IA) that produces a two to one aging acceleration and thus is effectively aged 500 hours. The current levels are increased in a similarly manner to 3·IA, 4·IA, . . . , 16·IA for sections 606, 608, . . . , 632, respectively, until the sixteenth section 632 is aged at a 16 to 1 rate to produce a section of pixels that have an effective age of 4000 hours. After aging is completed in this manner, the display has pixels ranging from 250 hours to 4000 hours in effective age. The reference pixels 632 remain un-aged.

Figure 7A:
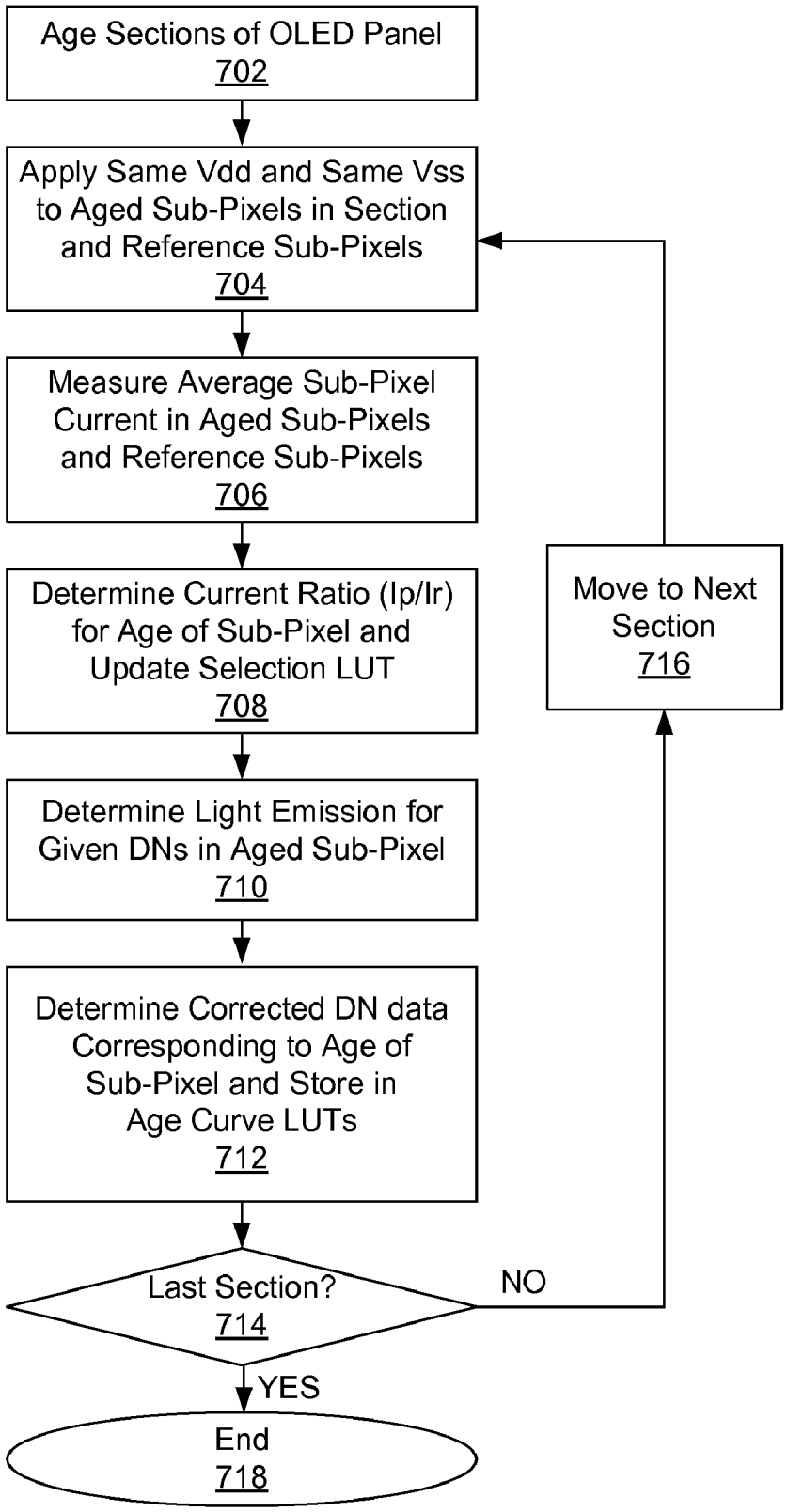
FIG. 7A illustrates a method of determining corrected digital numbers (DNs) to use with aged sub-pixels of an AMOLED display using current ratios, according to one embodiment of the present invention.

FIG. 7A illustrates a method of determining corrected digital numbers (DNs) to use with aged sub-pixels of an AMOLED display using current ratios, according to one embodiment of the present invention. According to the method of FIG. 7A, a predetermined reference voltage is applied to the OLED sub-pixels in differently aged sections of the aged OLED 600 (FIG. 6) and the resulting current and light emission in the OLED sub-pixels are measured. As the OLED display ages, current through the OLEDs will decrease and the current to light efficiency will also decrease. Therefore, the current decrease is a measure of decrease in OLED efficiency, from which a correction to DN may be deduced. An assumption in the method of FIG. 7A is that the efficiency change in the OLED is due to aging and not some other ambient parameter, which is true in many practical instances.

More specifically, at step 702 the sections of the OLED panel are aged, for example, according to the method illustrated with reference to FIG. 6. Then, at step 704 same supply voltages Vdd and Vss (see FIGS. 5A and 5B) are applied to the aged sub-pixels in one ages section (602, 604, . . . , or 630) and to the reference sub-pixels (un-aged sub-pixels) in un-aged section 632, and in step 706 the currents through one or more of the aged sub-pixels and the currents through one or more of the reference sub-pixels are measured and averaged to determine the average sub-pixel current (Ip) in the selected aged section (602, 604, . . . , or 630) and the average sub-pixel current (Ir) in the un-aged section 632. One way of measuring the sub-pixel current of an OLED display is taught in U.S. patent application Ser. No. 11/710,462, filed by Walter Edward Naugler, Jr., et al. on Feb. 22, 2007 and entitled "Method and Apparatus for Managing and Uniformly Maintaining Pixel Circuitry in a Flat Panel Display," which is incorporated by reference herein. Another way of measuring sub-pixel current of an OLED display is taught in U.S. patent application Ser. No. 12/018,455 filed by Walter Edward Naugler, Jr., et al. on Jan. 23, 2008 and entitled "Sub-Pixel Current Measurement for OLED Display," which is incorporated by reference herein. Other conventional methods of measuring the sub-pixel current of an OLED display may be used with embodiments of the present invention. Note that the current driving TFT T1 should be separated from the operation of the OLED D1 when current is measured, which can be accomplished by tying the gate of TFT T1 to the supply voltage Vss that is also coupled to the cathode of OLED D1 to place the TFT T1 in linear mode. Supply voltage Vdd is chosen to be small enough not to cause local heating in the sub-pixels. In measuring sub-pixel current in step 706, all other pixels are turned off by applying a gate voltage 120 to the gates of the TFTs T1 calculated to switch each sub-pixel off with minimum dark current. One way of switching OLED sub-pixels off to achieve minimum dark current is taught in U.S. patent application Ser. No. 12/033,527, filed by Walter Edward Naugler, Jr. on Feb. 19, 2008 and entitled "Minimizing Dark Current in OLED Display Using Modified Gamma Network," which is incorporated by reference herein. Other conventional methods of reducing dark current may be used with embodiments of the present invention.

At step 708, the current ratio (Ip/Ir) corresponding to the aged sub-pixel is determined. For fixed supply voltages Vdd and Vss, the current ratio (Ip/Ir) will be less than 1 as the aged sub-pixels have less efficiency. The amount of current ratio (Ip/Ir) less than 1 indicates the age of the pixel. Since it is known which section of the OLED panel the measured aged sub-pixel belongs to, the determined current ratio (Ip/Ir) is a measure of the effective age of the aged sub-pixel and the current ratio (Ip/Ir) and the age can be mapped. Thus, at step 708 the selection LUT 404 is also updated to reflect a proper mapping between the effective age (represented by the current ratio (Ip/Ir)) of the aged sub-pixel and an age curve LUT number corresponding to the effective age represented by the current ratio. Current from the aged sections and the current ratio (Ip/Ir) will steadily become smaller as the current measurement moves from the 250 hour-aged section 602 to the 4000 hour-aged section 632.

At step 710, light emission characteristics in the aged sub-pixel are determined. Specifically, at step 710 the light emission (brightness in candela) of the aged sub-pixel for given DNs is measured for a particular age of the OLED represented as the current ratio (Ip/Ir).

Figure 8:
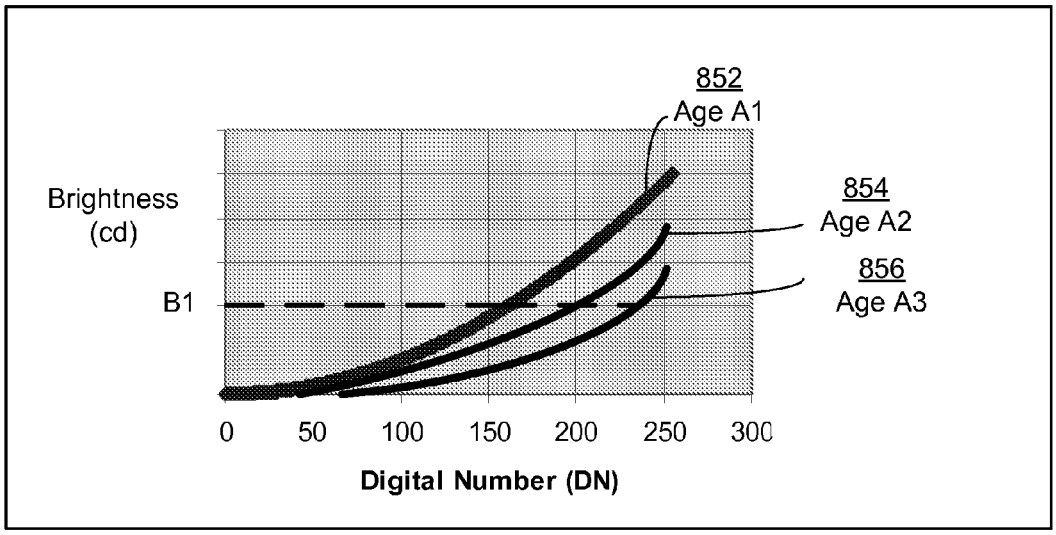
FIG. 8 illustrates the relationship between OLED brightness and digital numbers (DNs) for different ages of the OLEDs, according to one embodiment of the present invention.

At step 712, such light emission characteristics are used to determine the corrected digital number needed to achieve a particular brightness of an aged sub-pixel. FIG. 8 illustrates the relationship between OLED brightness and digital numbers (DNs) for different ages of the OLEDs, according to one embodiment of the present invention. For example, the three curves 852, 854, 856 show the brightness vs. digital number relationship for three different pixel ages A1, A2, and A3, respectively. The data for the graph in FIG. 8 may be obtained from the age test using the test display shown in FIG. 6, assuming that the laboratory test display in FIG. 6 is identical in design and production process as the OLED display units sent into the field for actual customer usage. Since the test display of FIG. 6 is also an actual display, the OLED display may be turned on by supplying a DN gray level to the pixels using a graphics board (not shown) and the pixel brightness may be measured, in order to obtain the DN data on the x-axis and the brightness data on the y-axis. The brightness of the pixels may be measured in candelas using an optical photometer.

From the graph in FIG. 8 it is possible to determine the digital number (DN) needed to achieve certain brightness in the OLED for different ages of the OLED sub-pixels. For example, curves 852, 854, 856 represent the relations between DN and achieved brightness for sub-pixels aged A1, A2, A3, respectively, with A3 being the most aged, followed by A2, and A1 being the least aged. In order to achieve a brightness of B1, sub-pixel aged A1 (curve 852) requires DN of 150, sub-pixel aged A2 (curve 854) requires DN of 200, and sub-pixel aged A3 (curve 856) requires DN of approximately 230. If sub-pixel aged A1 is the reference sub-pixel, sub-pixel aged A2 requires DN correction (ΔDN) of +50 for standard DN of 150, and sub-pixel aged A3 requires DN correction (ΔDN) of +80 for standard DN. Thus, at step 712 such DN correction data with respect to a standard DN 150 is also stored in each of the age curve LUTs 460 corresponding to the age (A2, A3) of the sub-pixel.

Steps 704, 706, . . . , 712 are repeated, moving from one aged section (602, 604, . . . , 630) to another aged section (602, 604, . . . , 630) in step 716, until the last aged sub-pixel section is reached in step 714 and the process ends 718. Note that the method of FIG. 7A is most effective if (i) the TFTs in the AMOLED display are stable, (ii) the reference pixels are stable and remain in the initial state over the lifetime of the display, (iii) the temperature of the OLED display is uniform during measurement of the current, (iv) the test currents used do not appreciably increase the temperature, (v) the test displays are from a stable production process, and (vi) the gamma networks 104 in the test display of FIG. 6 are same as those that would be included in OLED displays that are put in actual use in the field.

Figure 7B:
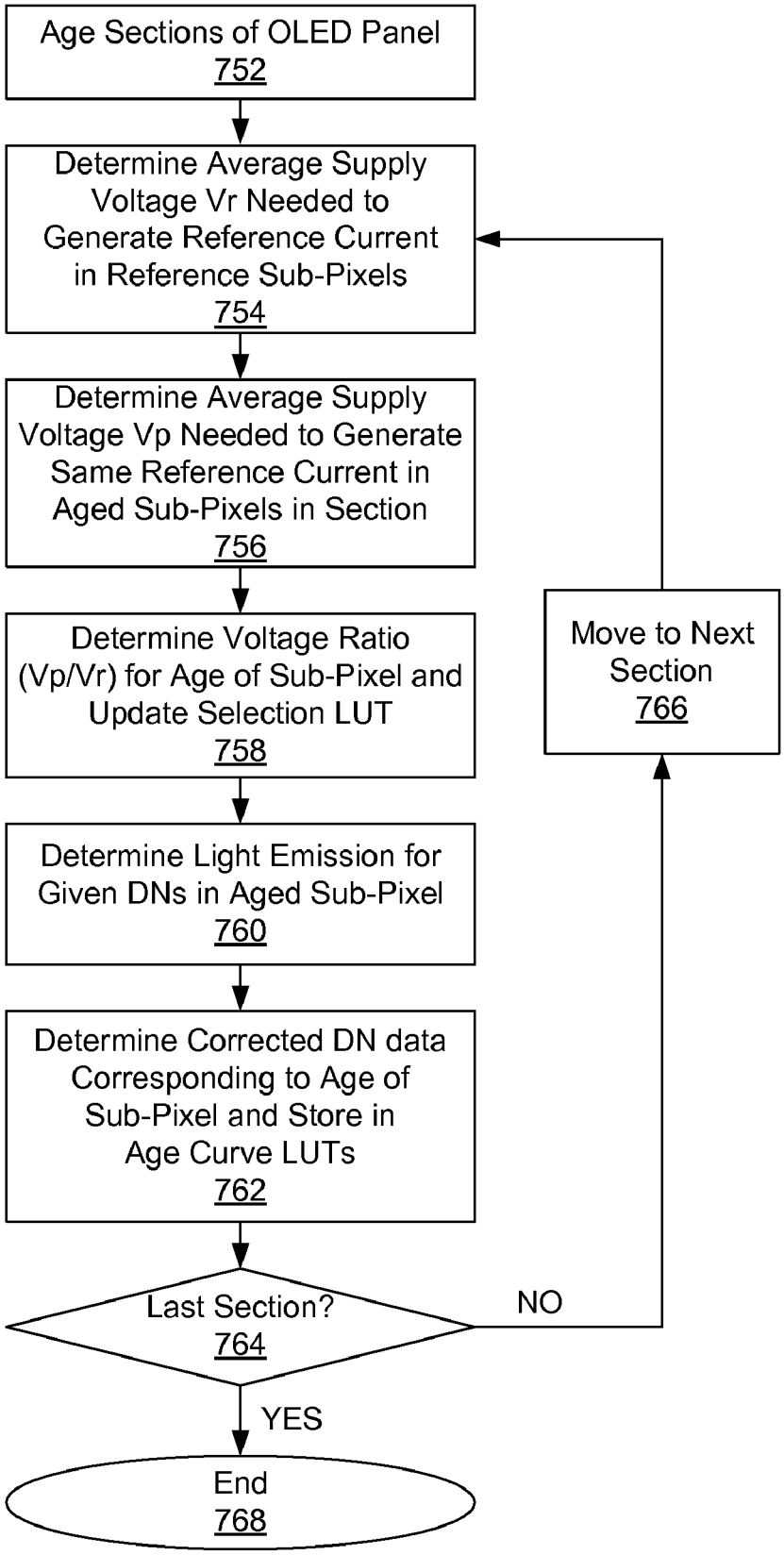
FIG. 7B illustrates a method of determining corrected digital numbers (DNs) to use with aged sub-pixels of an AMOLED display using voltage ratios, according to one embodiment of the present invention.

FIG. 7B illustrates a method of determining corrected digital numbers (DNs) to use with aged sub-pixels of an AMOLED display using voltage ratios, according to one embodiment of the present invention. According to the method of FIG. 7B, a predetermined reference current is applied to the OLED sub-pixels to differently aged sections of the aged OLED display 600 (FIG. 6) and the voltage (Vtotal=Vdd−Vss in FIGS. 5A and 5B) across the OLED sub-pixel and light emission in the OLED sub-pixels are measured. In one embodiment, the OLED sub-pixel may be forced to have the reference current flow using conventional feedback circuits (not shown herein). If Vss is fixed (e.g., at ground), Vtotal can be measured by measuring Vdd. As the OLED ages, the voltage (Vtotal=Vdd−Vss) required to have the reference current flow through the OLEDs will increase. Therefore, the voltage increase is a measure of decrease in the OLED efficiency, from which a correction to DN may be deduced. An assumption in the method of FIG. 7B is that the efficiency change in the OLED is due to aging and not some other ambient parameter, which is true in many practical instances.

More specifically, at step 752 the sections of the OLED panel are aged, for example, according to the method illustrated with reference to FIG. 6. Then, at step 754 the average supply voltage Vdd (referred to as Vr) (with Vss fixed) needed to force the predetermined reference current in one or more of the reference sub-pixels in the reference pixel section 632 is determined. Also, at step 756, the average supply voltage Vdd (referred to as Vp) (with Vss fixed) needed to force the predetermined reference current in one or more of the aged sub-pixels in the aged pixel section (602. 604, . . . , 630) is determined.

At step 758, the voltage ratio (Vp/Vr) corresponding to the aged sub-pixels is determined. For fixed reference current and fixed Vss, the voltage ratio (Vp/Vr) will be greater than 1 as the aged sub-pixels have less efficiency. The amount of voltage ratio (Vp/Vr) greater than 1 indicates the age of the pixel. Since it is known which section of the OLED panel the measured aged sub-pixels belong to, the determined voltage ratio (Vp/Vr) is a measure of the effective age of the measured sub-pixels and the voltage ratio (Vp/Vr) and the age can be mapped. Thus, at step 758 the selection LUT 404 is also updated to reflect a proper mapping between the effective age (represented by voltage ratio) of the aged sub-pixels and an age curve LUT number corresponding to the effective age represented by the voltage ratio. The voltage Vp needed for the aged sections and the voltage ratio (Vp/Vr) will steadily become larger as the voltage measurement moves from the 250 hour-aged section 602 to the 4000 hour-aged section 632.

At step 760, light emission characteristics in the aged sub-pixel are determined. Specifically, at step 760 light emission (brightness in candela) of the aged sub-pixel for given DNs is determined. At step 762, such light emission characteristics are used to determine the corrected digital number needed to achieve a particular brightness of an aged sub-pixel, similar to the embodiment of FIG. 7A, and such DN correction data with respect to a standard DN is also stored in each of the age curve LUTs 460 corresponding to the age of the sub-pixel.

The process of steps 754, 756, . . . , 762 are repeated, moving from one aged section (602, 604, . . . , 630) to another aged section (602, 604, . . . , 630) in step 766, until the last aged sub-pixel section is reached in step 764 and the process ends 768. Note that the method of FIG. 7B is also most effective if (i) the TFTs in the AMOLED display are stable, (ii) the reference pixels are stable and remain in the initial state over the lifetime of the display, (iii) the temperature of the OLED display is uniform during measurement of the current, (iv) the test currents used do not appreciably increase the temperature, (v) the test displays are from a stable production process, and (vi) the gamma networks 104 in the test display of FIG. 6 are same as those that would be included in OLED displays that are put in actual use in the field.

A possible advantage of using the voltage ratio embodiment of FIG. 7B over the current ratio embodiment of FIG. 7A is that the same current is forced through the reference pixels and aged pixels. The change in the supply voltage in the voltage ratio embodiment of FIG. 7B is caused only by an increase in the OLED voltage, Voled (see FIGS. 5A and 5B). On the other hand, the current change in the current ratio embodiment of FIG. 7A is caused by changes in both the OLED voltage (Voled) and the OLED current (Ioled), which may slightly reduce the accuracy of the current ratio embodiment of FIG. 7A.

Figure 9A:
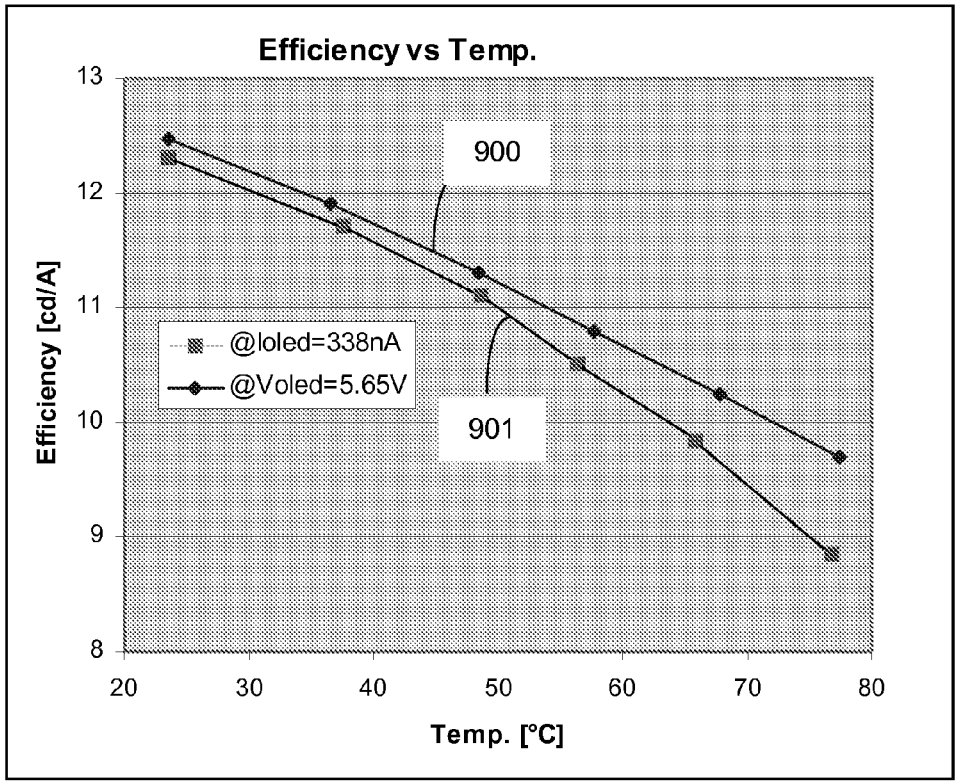
FIG. 9A is a graph illustrating OLED efficiency versus temperature.

FIG. 9A is a graph illustrating OLED efficiency versus temperature. The OLED efficiency is measured in candela/ampere (cd/A) and the temperature is measured in degrees Celsius. Curve 900 shows the efficiency per degree centigrade when the current through the OLED material is a constant 338 nA. Curve 901 shows the OLED efficiency per degree Celsius when the voltage across the OLED is constant 5.65 volts. While the absolute change in OLED efficiency shown in the graph of FIG. 9A for approximately 50 degree change in temperature is only 2.5 to 3.0 cd/A in absolute value, the percentage change in the efficiency is as high as approximately 25%. Therefore, if the efficiency and light emission characteristics of the OLED sub-pixels were measured at an initial timing T0 (the initial reading at the factory) in a controlled environment having room temperature (e.g., 20 degrees Celsius) and then put in actual use on a hot day with higher temperature, the OLED material would appear to be aged further than it really was and any correction made on the seeming age would be incorrect due to affects of the temperature change.

One of the benefits of using the current ratio or voltage ratio as explained above with reference to FIGS. 7A and 7B is that the effects of ambient temperature tends to be cancelled out in terms of producing a uniform OLED display. That is, ambient temperature will change the efficiency of un-aged and operating sub-pixels by the same factor, which will cancel out when a ratio of voltage or current is taken. However, the absolute brightness of the OLED sub-pixels will be affected by the ambient temperature. In some displays applications, using voltage or current ratios that are not corrected for ambient temperature may produce satisfactory results, but in other applications compensation for the effects of ambient temperature may be needed for more accurate display.

One assumption is that any change in the efficiency of the un-aged, reference sub-pixels 632 must be due to ambient temperature, since they are not aged. Under extreme conditions, light can also affect the measured pixel impedance. However, in normal use light has little effect on transparent OLED materials and very little affect on polysilicon which are used in the TFTs of most OLED displays. In the case of TFTs using a-Si, the effect of ambient light may be greater if the TFTs are not protected, but in this case the TFTs are protected from the light emitted by the OLEDs and the ambient light. Therefore, any change in the efficiency of the un-aged sub-pixels must be due to ambient temperature variance from the initial room temperature efficiency at the factory.

Figure 9B:
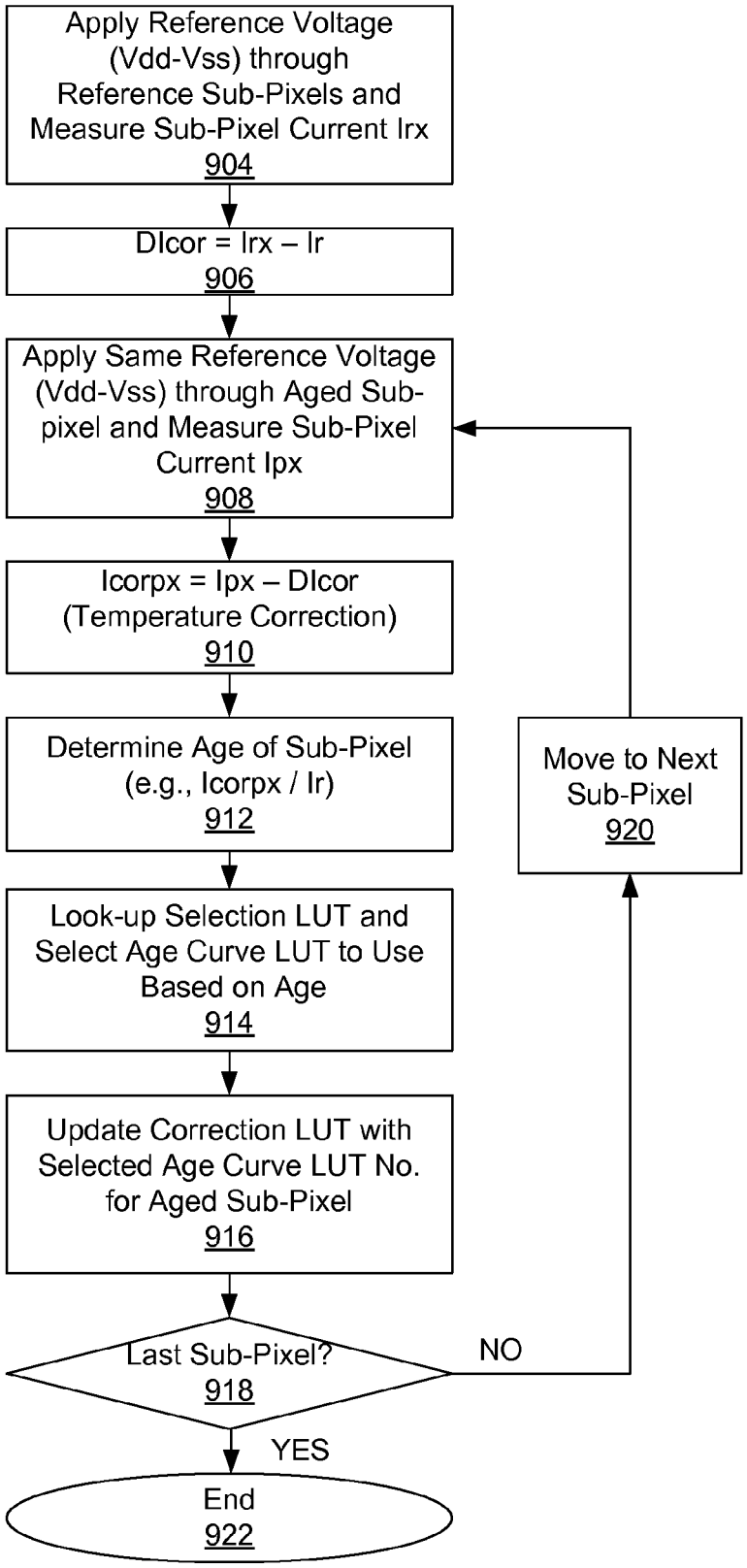
FIG. 9B illustrates a method of determining the appropriate age curve look-up table (LUT) to use for age compensation using current ratios with compensation for temperature variation, according to one embodiment of the present invention.
Figure 9C:
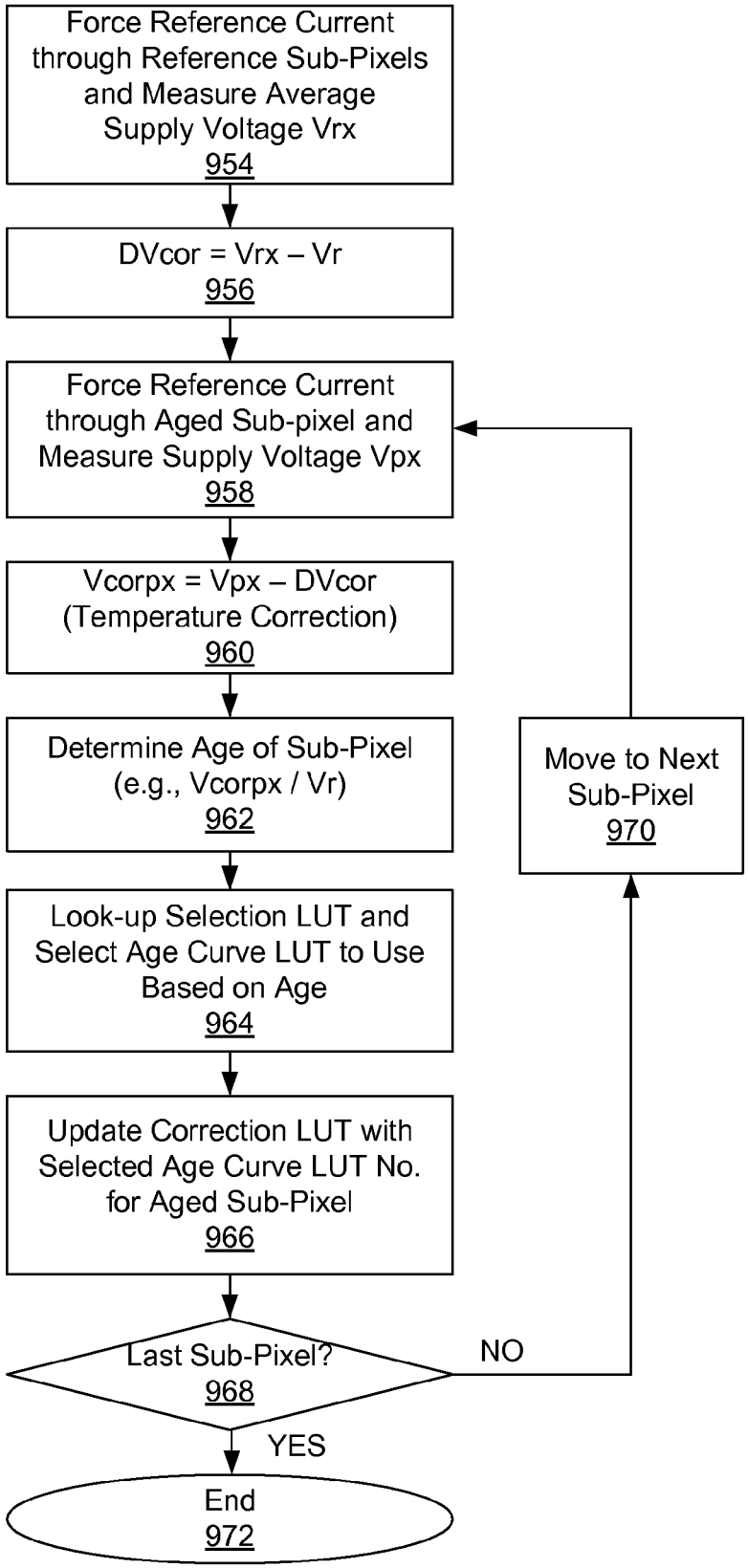
FIG. 9C illustrates a method of determining the appropriate age curve look-up table (LUT) to use for age compensation using voltage ratios with compensation for temperature variation, according to one embodiment of the present invention.

FIG. 9B illustrates a method of determining the appropriate age curve look-up table (LUT) to use for age compensation using current ratios with compensation for temperature variance, according to one embodiment of the present invention. The method of FIG. 9B is used during calibration of the AMOLED display to determine how aged the OLED sub-pixels are and how to compensate for the reduced light efficiency of the aged OLED sub-pixels, together with correction for variation in the ambient temperature. The method of FIG. 9B may be performed by the calibration engine 402 (see FIG. 4A). The method of FIG. 9B is carried out with respect to an aged AMOLED display that has been in use for some time, and may be performed multiple times during the life of the AMOLED display, for example, periodically, or during inactive periods of the AMOLED display, etc. Note that the aged AMOLED display used with the methods of FIGS. 9B and 9C is one that has been in actual use and is separate from the test OLED panel 600 shown in FIG. 6 which was used to generate the age curve LUTs according to the methods described in FIGS. 7A and 7B. However, in one embodiment the actual panel in use may also include un-aged, un-used reference pixels similar to the reference pixels 632 in FIG. 6. Such reference pixels on the actual panel in use have minimal aging and are expected to stay in their pristine original state despite being accessed occasionally for calibration. In another embodiment the actual panel in use does not include un-aged, un-used reference pixels, but the methods of FIGS. 9A and 9B may use the youngest pixels in place of the reference pixels in such other embodiment.

At step 904, a reference voltage (Vdd-Vss) is applied to the reference sub-pixels 632 and the average reference sub-pixel current Irx of the reference sub-pixels 632 is measured. At step 906, the reference sub-pixel current Ir that was measured at an initial time (e.g., time T0 measured at room temperature in a laboratory, same as reference sub-pixel current Ir in FIG. 7A) is subtracted from the average reference sub-pixel current Irx to determine DIcor, i.e., DIcor=Irx−Ir. Since the reference sub-pixels 632 are not aged by use even after passage of time, any change in the sub-pixel current in the reference sub-pixels 632 must be due to change in the field ambient temperature in which the sub-pixel current was measured from the controlled temperature conditions in the laboratory or factory. Thus, DIcor represents the change in sub-pixel current in the reference sub-pixels 632 that is caused by change in the ambient temperature, and may be either positive or negative. The change in sub-pixel current caused by change in the ambient temperature, DIcor, would be the equally applicable to other aged sub-pixels other than the reference sub-pixels, since both the aged sub-pixels and the un-aged reference sub-pixels would undergo the same change in ambient temperature.

At step 908, the same reference voltage (Vdd−Vss) is applied to the aged sub-pixel and the aged sub-pixel current Ipx of the aged sub-pixel is measured. Then, at step 910, DIcor determined in step 906 is subtracted from the aged sub-pixel current to obtain the temperature-corrected aged sub-pixel current Icorpx, i.e., Icorpx=Ipx−DIcor. As explained above, the temperature correction DIcor would be the equally applicable to the aged sub-pixels, since both the aged sub-pixels and the un-aged reference sub-pixels would undergo the same change in ambient temperature. Thus, Icorpx is a measure of the aged sub-pixel current free from variations that could have been caused by change in ambient temperature. At step 912 the age of the measured sub-pixel is determined. In one embodiment, the age of the aged sub-pixel is determined by determining the current ratio Icorpx/Ir, which would be equivalent to the current ratio (Ip/Ir) determined in step 708 of FIG. 7A, since Icorpx has been compensated for any temperature variation. As explained above, the determined current ratio (Icorpx/Ir) is a measure of the effective age of the measured sub-pixel.

Thus, at step 914 calibration engine 402 looks up selection LUT 404 to select the proper age curve LUT number corresponding to the determined age of the aged sub-pixel based on the current ratio (Icorpx/Ir). At step 916 calibration engine 402 updates (412 in FIG. 4A) correction LUT 456 in the age correction circuit 408 to reflect the selected age curve LUT number for the aged sub-pixel. That way, in normal operation, standard DNs 101 for the aged sub-pixel will be corrected by the selected age curve LUT 460. The process of steps 904, 906, . . . , 916 are repeated, moving from sub-pixel to sub-pixel in step 920, until the last aged sub-pixel is reached in step 918 and the process ends 922.

FIG. 9C illustrates a method of determining the appropriate age curve look-up table (LUT) to use for age compensation using voltage ratios with compensation for temperature variance, according to one embodiment of the present invention. The method of FIG. 9C is used during calibration of the AMOLED display to determine how aged the OLED sub-pixels are and how to compensate for the reduced light efficiency of the aged OLED sub-pixels, together with correction for variation in the ambient temperature. The method of FIG. 9C may be performed by the calibration engine 402 (see FIG. 4A). The method of FIG. 9C is carried out with respect to an aged AMOLED display that has been in use for some time, and may be performed multiple times during the life of the AMOLED display, for example, periodically, or during inactive periods of the AMOLED display, etc.

At step 954, a reference current is forced through the reference sub-pixels 632 and the average supply voltage Vrx needed across the reference sub-pixels to have such reference current flow is measured. At step 956, the reference sub-pixel voltage Vr measured at an initial time (e.g., time T0 measured at room temperature in a laboratory, same as reference sub-pixel voltage Vr in FIG. 7B) is subtracted from the average reference sub-pixel voltage Vrx to determine DVcor, i.e., DVcor=Vrx−Vr. Since the reference sub-pixels 632 are not aged by use even after passage of time, any change in the sub-pixel voltage in the reference sub-pixels 632 must be due to change in the field ambient temperature in which the sub-pixel voltage was measured from the controlled temperature conditions in the laboratory or factory. Thus, DVcor represents the change in sub-pixel voltage that is caused by change in the ambient temperature, and may be either positive or negative. The change in sub-pixel voltage caused by change in the ambient temperature, DVcor, would be the equally applicable to other aged sub-pixels other than the reference sub-pixels, since both the aged sub-pixels and the un-aged reference sub-pixels would undergo the same change in ambient temperature.

At step 958, the same reference current is forced through an aged sub-pixel and the average supply voltage Vpx needed across the aged sub-pixel to have such reference current flow is measured. Then, at step 960, DVcor determined in step 956 is subtracted from the aged sub-pixel voltage Vpx to obtain the temperature-corrected aged sub-pixel voltage Vcorpx, i.e., Vcorpx=Vpx−DV or. As explained above, the temperature correction DVcor would be the equally applicable to the aged sub-pixels, since both the aged sub-pixels and the un-aged reference sub-pixels would undergo the same change in ambient temperature. Thus, Vcorpx is a measure of the aged sub-pixel voltage free from variations that could have been caused by change in ambient temperature. Thus, at step 962 the age of the measured sub-pixel is determined. In one embodiment, the age of the aged sub-pixel is determined by the voltage ratio Vcorpx/Vr, which would be equivalent to the current ratio (Vp/Vr) determined in step 758 of FIG. 7B, since Vcorpx has been compensated for any temperature variation. As explained above, the determined voltage ratio (Vcorpx/Vr) is a measure of the effective age of the measured sub-pixel.

Thus, at step 964 calibration engine 402 looks up selection LUT 404 to select the proper age curve LUT number corresponding to the determined age of the aged sub-pixel based on the voltage ratio (Vcorpx/Vr). At step 966 calibration engine 402 updates (412 in FIG. 4A) correction LUT 456 in the age correction circuit 408 to reflect the selected age curve LUT number for the aged sub-pixel. That way, in normal operation, standard DNs 101 for the aged sub-pixel will be corrected by the selected age curve LUT 460. The process of steps 954, 956, . . . , 966 are repeated, moving from sub-pixel to sub-pixel in step 970, until the last aged sub-pixel is reached in step 968 and the process ends 972.

According to the present invention, it is possible to conveniently determine the age of an aged sub-pixel relative to un-aged reference sub-pixels using voltage ratios or current ratios, and correlate such age measurement with the correction that needs to be made to the DNs in order to compensate for reduced light efficiency of the aged sub-pixels of the OLED display. When determining the age of the sub-pixels, deviations that may be caused by variations in the ambient temperature from the initial temperature in controlled environments are also compensated for according to the various embodiments of the present invention.

Upon reading this disclosure, those of skill in the art will appreciate still additional alternative structural and functional designs for correcting digital numbers in order to compensate for reduced light efficiency of the aged sub-pixels of the OLED display. For example, although various embodiments of the present invention are illustrated as using voltage ratios or current ratios, the age of the sub-pixels do not necessarily have to be determined using strictly ratios, and any comparison of the current or voltage in the aged sub-pixels relative to the current or voltage in un-aged reference sub-pixels may be used. For instance, differences in the current or voltage rather than the current ratios or voltage ratios may be used. Thus, while particular embodiments and applications of the present invention have been illustrated and described, it is to be understood that the invention is not limited to the precise construction and components disclosed herein and that various modifications, changes and variations which will be apparent to those skilled in the art may be made in the arrangement, operation and details of the method and apparatus of the present invention disclosed herein without departing from the spirit and scope of the invention as defined in the appended claims.

What is claimed is:

1. A method of determining compensation needed for reduced light efficiency in aged sub-pixels of an active matrix organic light-emitting diode (OLED) display, the method comprising:

applying a predetermined voltage across one or more of reference sub-pixels that are not aged and determining a first current through said one or more of the reference sub-pixels;

determining a current difference between the first current and a reference current, the reference current corresponding to current of said one or more of the reference sub-pixels with the predetermined voltage applied to said one or more of the reference sub-pixels at an initial timing, and the current difference being indicative of the change in current of said one or more of the reference sub-pixels due to change in ambient temperature in which the active matrix OLED display is placed;

applying the predetermined voltage across an aged sub-pixel and determining a second current through said aged sub-pixel;

subtracting the current difference from the second current to obtain a third current, the third correct corresponding to the second current with correction for the change in ambient temperature;

determining an age of the aged sub-pixel based on the third current relative to the reference current;

selecting one of a plurality of age curve look-up tables to use for correction of digital numbers indicative of desired brightness in said aged sub-pixel based upon the determined age of said aged sub-pixel, each of the plurality of age curve look-up tables corresponding to a different age of the aged sub-pixel and mapping the digital numbers to said corrections to be made to the digital numbers for the corresponding age of the aged sub-pixel and one or more of the aged sub-pixels of the OLED display being assigned to use said one of the age curve look-up tables for correction of the digital numbers.

2. The method of claim 1, wherein the active matrix OLED display includes a plurality of sections of sub-pixels, the sections including at least a first section including the aged sub-pixels and a second section including the reference sub-pixels that are not aged, and determining the first current includes measuring the first current through two or more of the reference sub-pixels and averaging the measured first current.

3. The method of claim 1, wherein each of the sub-pixels of the active matrix OLED display includes a thin film transistor configured to drive an OLED of the sub-pixel, and current through the aged sub-pixel or the reference sub-pixel is measured with the thin film transistor biased in linear mode.

4. The method of claim 1, wherein the age of said aged sub-pixel is determined based on a current ratio of the third current to the reference current, the current ratio being less than one and being smaller as the sub-pixels have longer effective age.

5. The method of claim 1, wherein the age of said aged sub-pixel is determined based on a difference between the third current and the reference current.

6. A method of determining compensation needed for reduced light efficiency in aged sub-pixels of an active matrix organic light-emitting diode (OLED) display, the method comprising:

forcing a predetermined current through one or more of reference sub-pixels that are not aged and determining a first voltage across said one or more of the reference sub-pixels;

determining a voltage difference between the first voltage and a reference voltage, the reference voltage corresponding to voltage across said one or more of the reference sub-pixels with the predetermined current flow through said one or more of the reference sub-pixels at an initial timing, and the voltage difference being indicative of the change in voltage across said one or more of the reference sub-pixels due to change in ambient temperature in which the active matrix OLED display is placed;

forcing the predetermined current through an aged sub-pixel and determining a second voltage across said aged sub-pixel;

subtracting the voltage difference from the second voltage to obtain a third voltage, the third voltage corresponding to the second voltage with correction for the change in ambient temperature;

determining an age of the aged sub-pixel based on the third voltage relative to the reference voltage;

selecting one of a plurality of age curve look-up tables to use for correction of digital numbers indicative of desired brightness in said aged sub-pixel based upon the determined age of said aged sub-pixel, each of the plurality of age curve look-up tables corresponding to a different age of the aged sub-pixel and mapping the digital numbers to said corrections to be made to the digital numbers for the corresponding age of the aged sub-pixel and one or more of the aged sub-pixels of the OLED display being assigned to use said one of the age curve look-up tables for correction of the digital numbers.

7. The method of claim 6, wherein the active matrix OLED display includes a plurality of sections of sub-pixels, the sections including at least a first section including the aged sub-pixels and a second section including the reference sub-pixels that are not aged, and determining the first voltage includes measuring the first voltage across two or more of the reference sub-pixels and averaging the measured first voltage.

8. The method of claim 6, wherein each of the sub-pixels of the active matrix OLED display includes a thin film transistor configured to drive an OLED of the sub-pixel, and voltage across the aged sub-pixel or the reference sub-pixel is measured with the thin film transistor biased in linear mode.

9. The method of claim 6, wherein the age of said aged sub-pixel is determined based on a voltage ratio of the third voltage to the reference voltage current, the voltage ratio being greater than one and being greater as the sub-pixels have longer effective age.

10. The method of claim 6, wherein the age of said aged sub-pixel is determined based on a difference between the third voltage and the reference voltage.

11. An active matrix organic light-emitting diode (OLED) display comprising:

a plurality of OLED elements arranged in a plurality of rows and a plurality of columns, each of the OLED elements corresponding to a sub-pixel of the OLED display; and an active matrix drive circuit configured to drive current through the OLED elements, the active matrix drive circuit including:

a plurality of age curve look-up tables each corresponding to a different age of aged sub-pixels of the OLED display and mapping digital numbers to corrections to be made to the digital numbers for the corresponding age of the aged sub-pixel, one or more of the aged sub-pixels of the OLED display being assigned to use said one of the age curve look-up tables for correction of the digital numbers; and a calibration circuit configured to:

apply a predetermined voltage across one or more of reference sub-pixels that are not aged and determine a first current through said one or more of the reference sub-pixels;

determine a current difference between the first current and a reference current, the reference current corresponding to current of said one or more of the reference sub-pixels with the predetermined voltage applied to said one or more of the reference sub-pixels at an initial timing, and the current difference indicative of the change in current of said one or more of the reference sub-pixels due to change in ambient temperature in which the active matrix OLED display is placed;

apply the predetermined voltage across an aged sub-pixel and determining a second current through said aged sub-pixel;

subtract the current difference from the second current to obtain a third current, the third correct corresponding to the second current with correction for the change in ambient temperature;

determine an age of the aged sub-pixel based on the third current relative to the reference current; and select one of said plurality of age curve look-up tables to use for correction of digital numbers indicative of desired brightness in said aged sub-pixel based upon the determined age of said aged sub-pixel.

12. The active matrix OLED display of claim 11, wherein each of the sub-pixels of the active matrix OLED display include a thin film transistor configured to drive an OLED of the sub-pixel, and current through the aged sub-pixel or the reference sub-pixel is measured with the thin film transistor biased in linear mode.

13. The active matrix OLED display of claim 11, wherein the age of said aged sub-pixel is determined based on a current ratio of the third current to the reference current, the current ratio being less than one and being smaller as the sub-pixels have longer effective age.

14. The active matrix OLED display of claim 11, wherein the age of said aged sub-pixel is determined based on a difference between the third current and the reference current.

15. An active matrix organic light-emitting diode (OLED) display comprising:

a plurality of OLED elements arranged in a plurality of rows and a plurality of columns, each of the OLED elements corresponding to a sub-pixel of the OLED display; and an active matrix drive circuit configured to drive current through the OLED elements, the active matrix drive circuit including:

a plurality of age curve look-up tables each corresponding to a different age of aged sub-pixels of the OLED display and mapping digital numbers to corrections to be made to the digital numbers for the corresponding age of the aged sub-pixel, one or more of the aged sub-pixels of the OLED display being assigned to use said one of the age curve look-up tables for correction of the digital numbers; and a calibration circuit configured to:

force a predetermined current through one or more of reference sub-pixels that are not aged and determine a first voltage across said one or more of the reference sub-pixels;

determine a voltage difference between the first voltage and a reference voltage, the reference voltage corresponding to voltage across said one or more of the reference sub-pixels with the predetermined current flow through said one or more of the reference sub-pixels at an initial timing, and the voltage difference indicative of the change in voltage across said one or more of the reference sub-pixels due to change in ambient temperature in which the active matrix OLED display is placed;

force the predetermined current through an aged sub-pixel and determine a second voltage across said aged sub-pixel;

subtract the voltage difference from the second voltage to obtain a third voltage, the third voltage corresponding to the second voltage with correction for the change in ambient temperature;

determine an age of the aged sub-pixel based on the third voltage relative to the reference voltage; and select one of a plurality of age curve look-up tables to use for correction of digital numbers indicative of desired brightness in said aged sub-pixel based upon the determined age of said aged sub-pixel.

16. The active matrix OLED display of claim 15, wherein each of the sub-pixels of the active matrix OLED display includes a thin film transistor configured to drive an OLED of the sub-pixel, and voltage across the aged sub-pixel or the reference sub-pixel is measured with the thin film transistor biased in linear mode.

17. The active matrix OLED display of claim 15, wherein the age of said aged sub-pixel is determined based on a voltage ratio of the third voltage to the reference voltage, the voltage ratio being greater than one and being greater as the sub-pixels have longer effective age.

18. The active matrix OLED display of claim 15, wherein the age of said aged sub-pixel is determined based on a difference between the third voltage and the reference voltage.

* * * * *